US009995316B2

(12) United States Patent
Hall et al.

(10) Patent No.: US 9,995,316 B2
(45) Date of Patent: Jun. 12, 2018

(54) BLOWER ASSEMBLY AND METHOD

(71) Applicant: Revcor, Inc., Carpentersville, IL (US)

(72) Inventors: Craig R. Hall, Hartford, WI (US); Nathan K. Shoemaker, Elgin, IL (US); Stephen A. Adamski, Prospect Heights, IL (US)

(73) Assignee: Revcor, Inc., Carpentersville, IL (US)

( * ) Notice: Subject to any disclaimer, the term of this patent is extended or adjusted under 35 U.S.C. 154(b) by 1049 days.

(21) Appl. No.: 14/204,818

(22) Filed: Mar. 11, 2014

(65) Prior Publication Data

US 2015/0260201 A1 Sep. 17, 2015

(51) Int. Cl.

| | |
|---|---|
| ***F04D 29/66*** | (2006.01) |
| ***F04D 17/04*** | (2006.01) |
| ***F04D 29/28*** | (2006.01) |

(52) U.S. Cl.

CPC ..... *F04D 29/666* (2013.01); *F04D 17/04* (2013.01); *F04D 29/283* (2013.01); *F04D 29/667* (2013.01)

(58) Field of Classification Search

CPC .... F04D 29/666; F04D 29/667; F04D 29/668; F04D 29/663; F04D 29/283; F04D 17/04; F05B 2240/33; F05B 2240/34; F05B 2260/96; F05B 2260/962

USPC ..... 415/53.1, 53.2, 53.3, 119; 416/203, 178, 416/187

See application file for complete search history.

(56) References Cited

U.S. PATENT DOCUMENTS 2,628,419 A * 2/1953 Wilken ..... F04D 29/283 219/107
2,894,681 A * 7/1959 Lunde ..... F04D 29/283 29/888.024

(Continued)

FOREIGN PATENT DOCUMENTS

EP 0785362 B1 12/2002
GB 2126653 A 3/1984

OTHER PUBLICATIONS

Specification Sheet, Specification of Electric Motors, <http://www.weg.net/>, publicly available at least one year prior to Mar. 11, 2014, p. 55.

(Continued)

*Primary Examiner* — Christopher Verdier
*Assistant Examiner* — Wayne A Lambert
(74) *Attorney, Agent, or Firm* — Fitch, Even, Tabin & Flannery LLP

(57) ABSTRACT

A blower assembly having a housing and a cross flow fan rotatably mounted to the housing. Rotation of the fan drives fluid flow through the housing and produces an eccentric vortex of fluid flow in the housing. The fan has a circular blade support that induces fluid flow with rotation of the fan which interacts with the eccentric vortex. The circular blade support has at least one flow interrupter configured and arranged to rotate through the interaction of the eccentric vortex and the flow induced by the circular blade support to disrupt the interaction between the eccentric vortex and the flow induced by the circular blade support. In this manner, the at least one flow interrupter reduces the effect of the unstable vortex-blade support interaction on the airflow through the blower assembly which stabilizes the air loading on the blower assembly motor and reduces noise.

33 Claims, 26 Drawing Sheets

(56) References Cited

U.S. PATENT DOCUMENTS 2,980,990 A * 4/1961 Sprouse ..... F04D 29/283 29/889.4
3,156,408 A * 11/1964 Whitenack, Jr. ..... F04D 29/283 415/53.1
3,223,313 A 12/1965 Kinsworthy
3,263,910 A * 8/1966 Bruno ..... F04D 17/04 415/148
3,385,511 A * 5/1968 Wentling ..... F04D 29/283 29/889.4
3,481,530 A * 12/1969 Korovkin ..... F04D 17/04 415/53.2
3,794,439 A * 2/1974 Haase ..... F04D 29/4226 415/53.1
3,809,503 A 5/1974 Schlicker et al.
3,921,272 A * 11/1975 Klonoski ..... F04D 29/283 29/513
4,470,753 A * 9/1984 Witzel ..... B60H 1/00471 415/116
4,474,534 A 10/1984 Thode
4,538,963 A * 9/1985 Sugio ..... F04D 29/283 415/119
4,639,193 A * 1/1987 Reichert ..... F04D 29/281 416/134 R
4,761,576 A * 8/1988 Savage ..... F04D 25/06 310/179
5,060,720 A 10/1991 Wollaber et al.
5,266,007 A 11/1993 Bushnell et al.
5,269,655 A * 12/1993 Chang ..... F04D 29/283 416/178
5,388,956 A * 2/1995 Pla ..... F04D 29/665 415/1
5,478,205 A * 12/1995 Chou ..... F04D 29/666 415/119
5,570,996 A * 11/1996 Smiley ..... F04D 29/4226 415/204
6,149,381 A * 11/2000 Lee ..... F04D 29/283 415/119
6,158,954 A * 12/2000 Nabeshima ..... F04D 29/283 415/119
6,220,818 B1 * 4/2001 Andulics ..... B63H 1/20 416/178
6,283,726 B1 * 9/2001 Fackelmann ..... F04D 29/283 415/58.4
6,345,951 B1 * 2/2002 Choi ..... F04D 29/283 415/1
6,345,956 B1 * 2/2002 Lin ..... F04D 29/282 415/119
6,353,303 B1 * 3/2002 Ramachandran ..... F04D 27/004 318/432
6,624,397 B2 9/2003 Tateishi
6,761,040 B2 * 7/2004 Ahn ..... F01D 5/14 416/203
7,210,907 B2 * 5/2007 Patti ..... F04D 29/282 416/178
7,566,262 B2 7/2009 Hu
7,722,311 B2 * 5/2010 Peterson ..... F04D 29/188 415/119
2003/0077174 A1 * 4/2003 Kim ..... F04D 29/283 416/186 R
2003/0159803 A1 8/2003 Hansen
2006/0233638 A1 * 10/2006 Chen ..... F04D 29/668 415/53.1
2010/0076606 A1 3/2010 Gatley et al.
2011/0033325 A1 2/2011 Ko
2012/0321494 A1 12/2012 Duke et al.

OTHER PUBLICATIONS

Induction Motor Control Theory, L M Photonics Ltd, <http://www.lmphotonics.com/m_control.htm>, accessed on Feb. 26, 2014, 6 pages.

Yong Cho et al., "Discrete Noise Prediction of Variable Pitch Cross-Flow Fans by Unsteady Navier-Stokes Computations." Journal of Fluids Engineering, vol. 125, May 2003, pp. 543-550.

H. Ilberg et al., "Flow Theory and Performance of Tangential Fans," Thermodynamics and Fluid Mechanics Group. Proceedings Institution of Mechanical Engineers, vol. 180, pt. 1, No. 19, published 1965-66, pp. 481-496.

Da-Sheng Lee et al., "Noise Reduction of a Cross-Flow Fan." Journal of the Chinese Institute of Engineers, vol. 20, No. 3, 1997, pp. 265-273.

R.C. Mellin et al., "Controlling the Tonal Characteristics of the Aerodynamic Noise Generated by Fan Rotors." Journal of Basic Engineering, Mar. 1970, pp. 143-154.

Pictures of Revcor Model BL6507 fan assembly, publicly available before Mar. 11, 2013, 8 pages.

* cited by examiner

BLOWER ASSEMBLY AND METHOD

FIELD

The invention relates to blower assemblies and, more particularly, blower assemblies that utilize tangential or cross flow fans.

BACKGROUND

Blower assemblies that utilize tangential or cross flow fans are known. These types of blower assemblies typically include a housing and a fan rotatably mounted in the housing. The fan has two or more discs that support a number of forward-curved blades configured to draw air into the housing, across the fan, and discharge the air from the housing with rotation of the fan. Although this type of blower may have only a few components, the flow of air through these blowers is quite complex. For example, near the cutoff of the housing, the fan may develop an eccentric vortex or eddy of airflow that circulates within a portion of the fan interior near the cutoff of the housing. Further, the airflow patterns in the blower assembly are unstable and vary unpredictably which affects the efficiency and operation of the fan, and the motor driving the fan, during operation of the blower assembly.

The complexities of the airflow patterns within blower assemblies utilizing cross flow fans produce a number of problems for blower manufacturers. For example, it may be desirable to minimize the aerodynamic noise a blower makes during start-up and operation of the blower. One type of aerodynamic noise from a blower is high-pitch noise produced by blades of the fan traveling past the cutoff of the housing. The fan blades traveling past the cutoff generate sharp velocity gradients in the airflow which generates a whine or whistling sound to the human ear.

Blowers using cross flow fans also produce a lower-pitch noise as the fan, and the motor driving the fan, speeds up and slows down in response to the unstable, changing airflow patterns in the blower assembly and the resulting changing air load on the fan. The changing speed of the fan may cause the fan to sound like it is revving up or slowing down rather than rotating at a fixed speed. The somewhat constant revving up and slowing down may be unpleasant to some users.

For example, some blowers utilize electric motors having a saddle-shaped speed-torque performance curve. As the torque required to rotate the fan changes (due to the changing air load from the unstable airflow patterns), the motor operating point moves along the speed-torque performance curve in response to the changing torque requirements. The motor's saddle-shaped speed-torque curve, however, means that at a particular moment during operation of the motor there may be two operating points along the speed-torque curve that will satisfy the air load required by the fan at that particular moment. This is problematic because if the motor is operating at a first operating point with a first speed and torque combination that satisfies a particular air load, then the air load deviates briefly and returns to its original value, the motor may "search" to a second operating point with a different speed but a similar torque as the first operating point. This "searching" from the first operating point to the second operating point produces an audible revving up or slowing down of the fan as the motor changes its position along the speed-torque curve, which may be undesirable in some applications.

DETAILED DESCRIPTION

Figure 1:
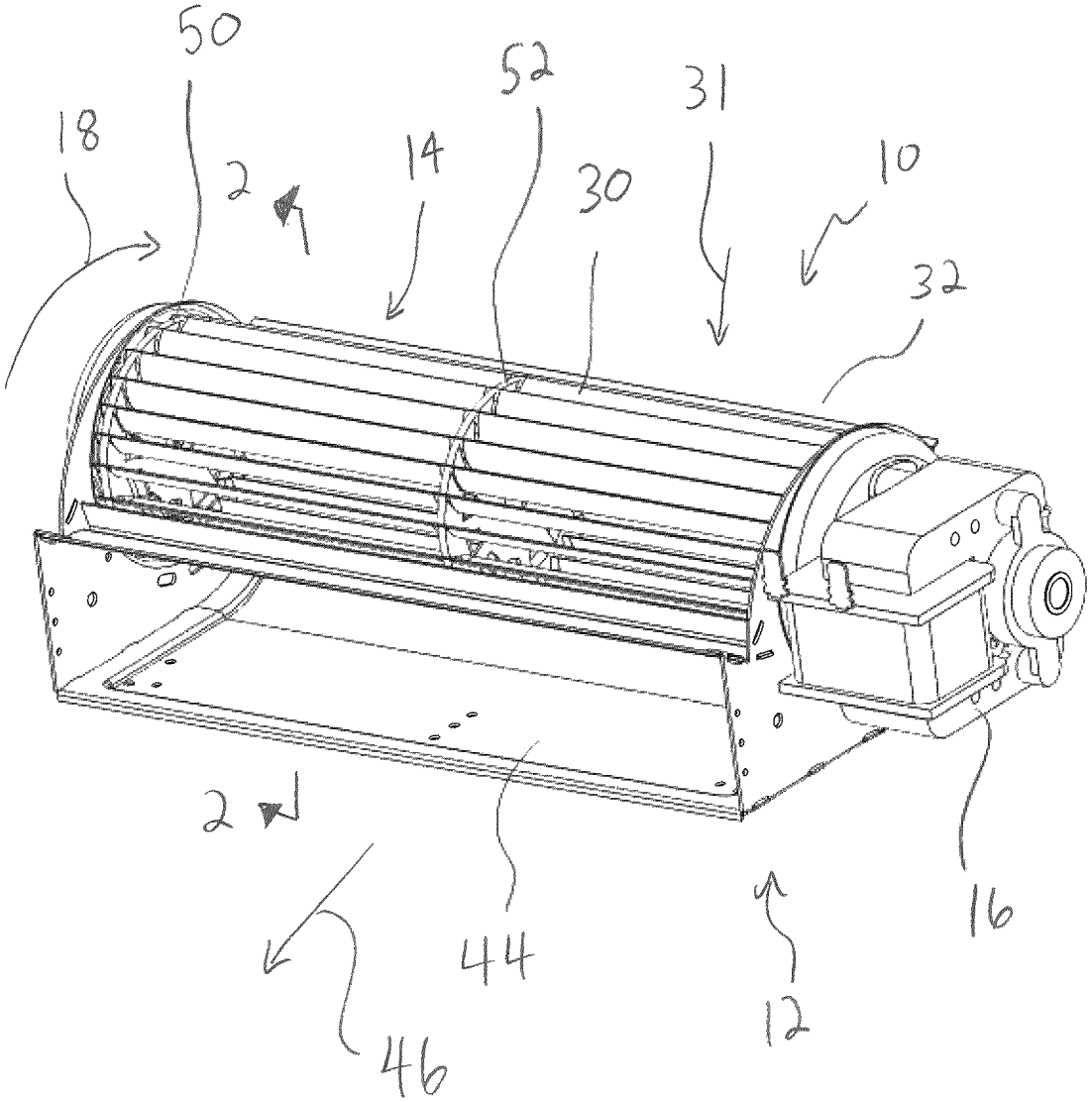
FIG. 1 is a perspective view of a blower assembly.

In accordance with one aspect of the present disclosure, a blower assembly is provided having more stable airflow patterns within the blower assembly and quieter operation than some conventional blowers. The blower assembly includes a housing, a cross flow fan mounted to the housing, and a circular blade support of the fan. The blower assembly further includes at least one interrupter of the circular blade support disposed radially outwardly from a center of the circular blade support. A plurality of blades of the fan are connected to the circular blade support radially outward from the at least one interrupter and are spaced circumferentially about the circular blade support.

The at least one interrupter is arranged and configured to break up an interaction between an eccentric vortex within the cross flow fan and flow induced by rotation of the circular blade support which improves the stability of air loading on the fan. More specifically, it has been discovered that the interaction between the eccentric vortex and the flow induced by rotation of the circular blade support rapidly and unpredictably varies in magnitude and direction which contributes to unstable air loading on the fan. It has also been discovered that the interaction between the eccentric vortex and the flow induced by rotation of the circular blade support produces a secondary flow generally perpendicular to a primary flow through the blower that further contributes to unstable air loading on the fan. The at least one interrupter imparts turbulence at the interaction between the eccentric vortex and the flow induced by rotation of the circular blade support which decouples the eccentric vortex from the blade supports and increases the stability of air loading on the fan and the motor which drives the fan. This improves the stability of the motor by permitting the motor to drive the fan with fewer adjustments to its speed and/or torque during operation. In this manner, the at least one interrupter of the circular blade support stabilizes the operation of the motor which, in turn, produces a more appealing quiet "hum" of the fan rather than audible acceleration and deceleration of the fan as occurs in some conventional blower assemblies.

In one form, the blower assembly includes a motor with a stator and a rotor for rotating the fan of the blower assembly. The rotor has high-resistance windings that produce a generally arc-shaped speed/torque performance curve of the motor rather than a saddle-shaped speed/torque performance curve as in some conventional blower assemblies. The motor with the high-resistance rotor generally has only one torque and speed combination for satisfying a given air load during operation of the fan. Thus, the motor moves to the one speed/torque combination that satisfies a given air load rather than searching between two different speed/torque combinations as in some conventional blower assemblies. In this manner, the motor having a high-resistance rotor reduces low-pitch operating noise of the blower assembly by reducing the frequency and magnitude of changes in the speed of the fan and the associated revving up and slowing down noises from the blower assembly.

The blower assembly may also include a fan with a blade support and blades spaced unevenly about a circumference of the blade support. The uneven spacing of the blades breaks up the sharp airflow velocity gradients near a cutoff of the housing as the blades travel past the cutoff. The uneven spacing of the blades thereby reduces high-pitch operating noises from the blower assembly such as the whine or whistling sound produced by some conventional blower assemblies with evenly spaced fan blades. In one approach, the spacing of the fan blades about the blade supports varies in a sinusoidal manner. As used herein, sinusoidal blade spacing on a blade support refers to a repetitive oscillation of the spacing between the blades about the blade support. In another approach, the spacing of fan blades about the blade supports varies in a non-sinusoidal manner, such as a random blade spacing.

In one form, the blower assembly includes a housing with a cutoff arranged and configured to maximize performance, minimize noise of the blower assembly, and maximize the stability of airflow in the blower assembly. The cutoff generally separates the suction side of the blower assembly from the pressure side. For example, the cutoff may have a bent shape with an inlet portion near the fan, an outlet portion extending toward an outlet of the housing, and an elbow between the inlet and outlet portions. It has been discovered that positioning the elbow at a predetermined position lower than an axis of rotation of the fan provides desirable performance, noise, and airflow stability of the blower assembly as discussed in greater detail below.

With reference to FIG. 1, a blower assembly 10 is provided having a relatively quieter operation when compared to some conventional blower assemblies. The blower assembly 10 has a housing 12, a rotor or fan 14 rotatably mounted in the housing 12, and a motor 16 for rotating the fan 14 in direction 18. The fan 14 may be a tangential or cross flow fan having forward curved blades 30 configured to draw air in direction 31 through an inlet opening 32 with rotation of the fan 14 in direction 18.

Figure 2:
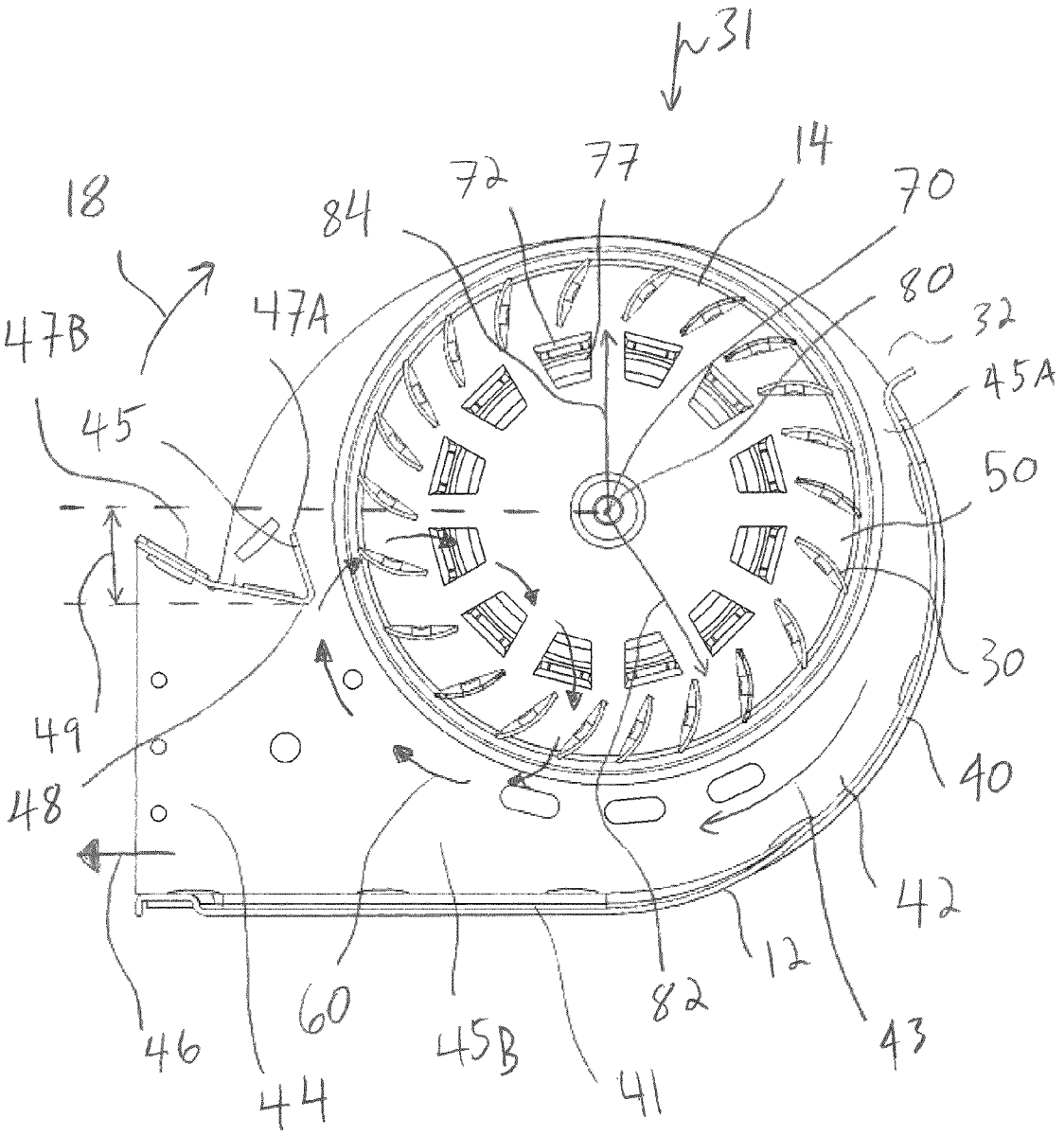
FIG. 2 is a cross-sectional view taken across line 2-2 in FIG. 1.
Figure 3:
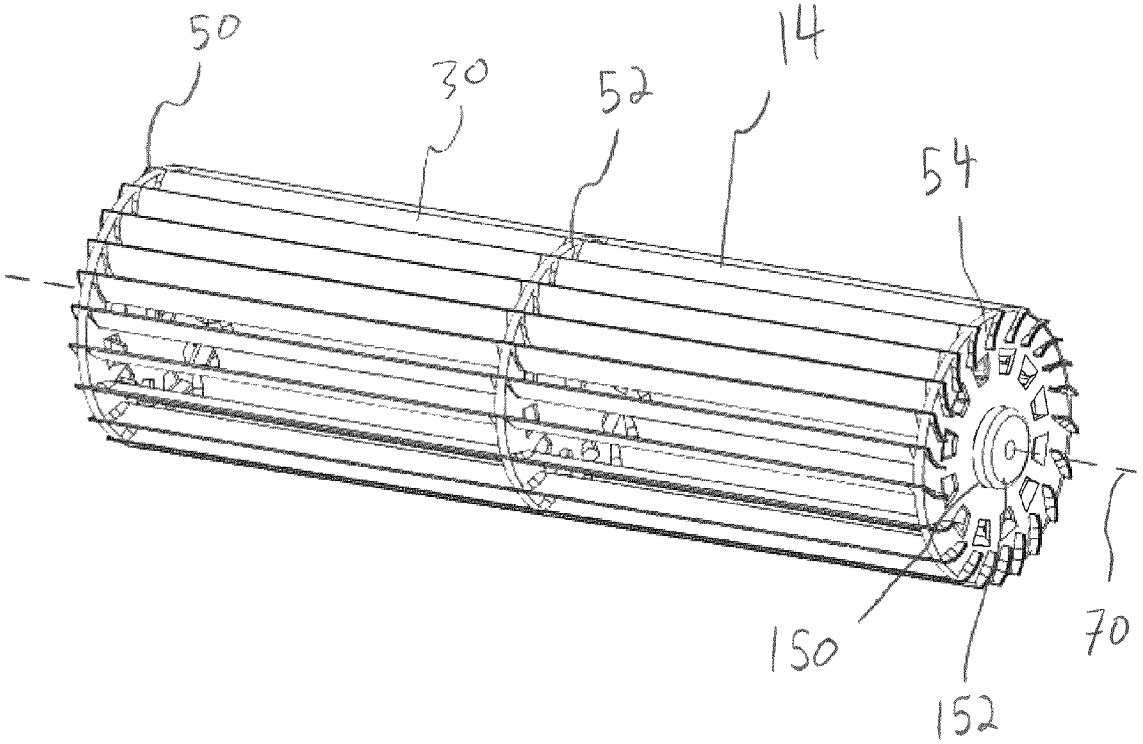
FIG. 3 is a perspective view of the fan of the blower assembly of FIG. 1.

With reference to FIGS. 2 and 3, the fan 14 includes blade supports, such as discs 50, 52, 54, to which the blades 30 are mounted. Rotation of the fan 14 in direction 18 produces an eccentric vortex 60 within the housing 12 and causes the discs 50, 52, 54 to induce flow patterns of their own, as discussed in greater detail below. The eccentric vortex 60 interacts with the flow induced by the rotating discs 50, 52, 54, and the interaction decreases the stability of the air loading on the fan 14 and the corresponding operation of the motor 16.

Figure 7:
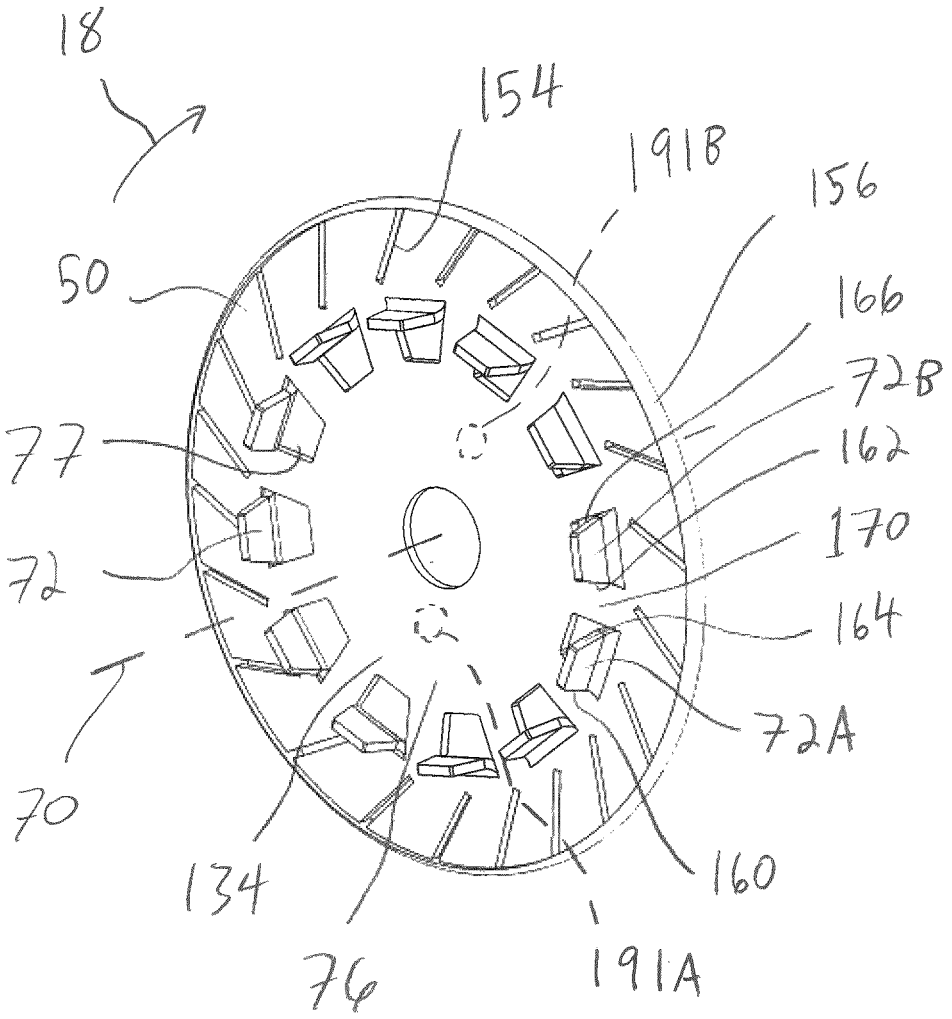
FIG. 7 is a perspective view of one of the discs of the fan of FIG. 3.

To improve the stability of the air loading on the fan 14 and the resulting operation of the motor 16, the discs 50, 52, 54 include one or more protrusions or flow interrupters, such as the tabs 72. In one form, the discs 50, 52, 54 have generally flat bodies 76 and the tabs 72 are bent to extend transversely to a face of the respective disc, such as the face 134 of the disc 50 as shown in FIG. 7. The bending of the tabs 72 creates openings 77 in the discs 50, 52, 54. The tabs 72 are configured and arranged to disrupt the interaction between the eccentric vortex 60 and the flow induced by the rotating discs 50, 52, 54. The interaction between the eccentric vortex 60 and the flow induced by the rotating discs 50, 52, 54 rapidly and unpredictably oscillates in magnitude and direction during rotation of the fan 14 and decreases the stability of airflow in the fan 14. The decreased stability of airflow in the fan 14 causes an increased noise of operation of the blower assembly 10, as discussed in greater detail below. In one approach, the tabs 72 are positioned on the discs 50, 52, 54 so that the tabs 72 rotate through the interaction of the eccentric vortex 60 and the flow induced by the rotating discs 50, 52, 54 to create turbulence at the area of vortex-disc flow interaction. This turbulence decouples the eccentric vortex 60 from the discs 50, 52, 54 and reduces the instability imparted by unstable vortex-disc flow interaction on the airflow in the fan 14 and reduces the noise of operation of the blower assembly 10.

With reference to FIG. 2, the housing 12 has a back wall 40 with a volute shape that forms a curved diffusion cone 42 between the fan 14 and the back wall 40 and directs airflow in direction 43. The diffusion cone 42 extends to an outlet 44 of the housing 12 where higher pressure air is discharged in direction 46 from the blower assembly 10. The diffusion cone 42 provides efficient conversion of velocity pressure into static air flow pressure at the outlet 44 with rotation of the fan 14.

The housing 12 also includes a cutoff 45 in close proximity to the fan 14 that separates a suction side 45A of the housing 12 from a discharge side 45B of the housing 12. The cutoff 45 may have a range of positions in the housing 12, a range of clearances between the fan 14 and the cutoff 45, and a variety of shapes, such as a wedge or saw-tooth configuration. The cutoff 45 has an inlet portion 47A, an outlet portion 47B, and an elbow 48. The elbow 48 is disposed a distance 49 below an axis of rotation 70 of the fan 14 and toward a bottom wall 41 of the housing 12. It has been discovered that blower assemblies having a distance 49 that is too small reduces the stability of the airflow within the blower assembly. It has also been discovered that blower assemblies having a distance 49 that is too large reduces the performance of the blower assembly. In one form, the fan 14 has an outer diameter in the range of approximately 2.0 inches to approximately 3.0 inches, preferably approximately 0.264 inches, and the distance 49 is in the range of approximately 0.45 inches to approximately 0.55 inches, preferably approximately 0.49 inches. The blower assembly 10 with the distance 49 sized to be approximately 0.49 inches may maximize performance and airflow stability while minimizing noise. The housing 12 may be a Model BL6507 assembly manufactured by Revcor, Inc. of Carpentersville, Ill., which is the assignee of the subject application and the fan 14 may have dimensions similar to the fan included with the Model BL6507 assembly.

Figure 4:
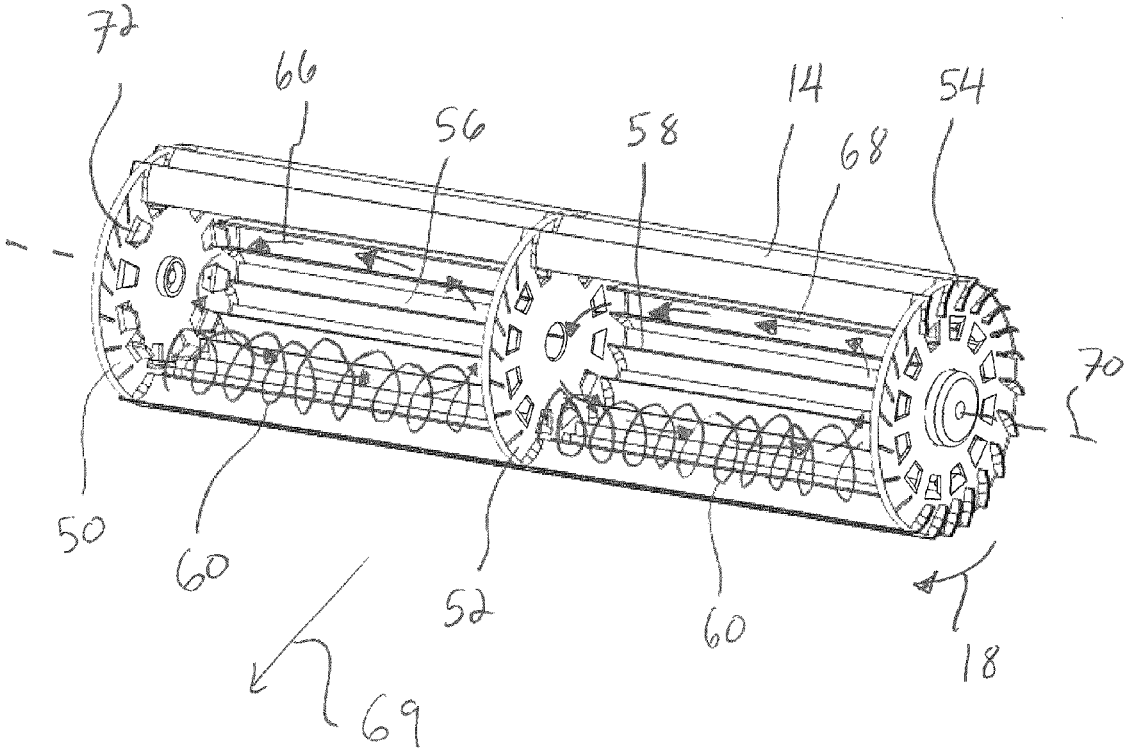
FIG. 4 is a perspective view similar to FIG. 3 with several of the blades of the fan removed.

With reference to FIGS. 3 and 4, the discs 50, 52, 54 support the ends and middle of the blades 30 and form interior spaces 56, 58 of the fan 14 between the discs 50, 52, and between the discs 52, 54. With reference to FIG. 4, rotation of the fan 14 in direction 18 creates an eccentric vortex 60 within the housing 12 and the interior spaces 56, 58 of the fan 14. As discussed in greater detail below, the rotation of the discs 50, 52, 54 in direction 18 induces airflow that interacts with the airflow of the eccentric vortex 60. The interaction of the flow caused by the rotating discs 50, 52 and the eccentric vortex 60 creates a pressure gradient from the disc 52 to the disc 50 in the upper half 63 (as viewed in FIG. 6) of the interior space 56 and an opposite pressure gradient from the disc 50 to the disc 52 in the lower half 64. The discs 52, 54 produce similar pressure gradients in the interior space 58. With reference to FIG. 4, the pressure gradients in the fan interior spaces 56, 58 produce corresponding secondary flows 66, 68 that travel generally perpendicular to a main flow 69 through the fan 14.

With reference to FIG. 2, the discs 50, 52, 54 each have a center 80 aligned with the axis of rotation 70 and the blades 30 are spaced radially a distance 82 from the center 80. The tabs 72 are spaced a radial distance 84 less than the radial distance 82 so that the tabs 72 travel through and break up the interaction between the vortex 60 and the flow induced by the rotating discs 50, 52, 54. Although only the disc 50 and its tabs 72 are shown in FIG. 2, the tab 72 of the discs 52, 54 operate in a similar manner and are positioned such that they travel through and disrupt the interaction between the vortex 60 flows produced by the respective discs 52, 54.

Figure 5:
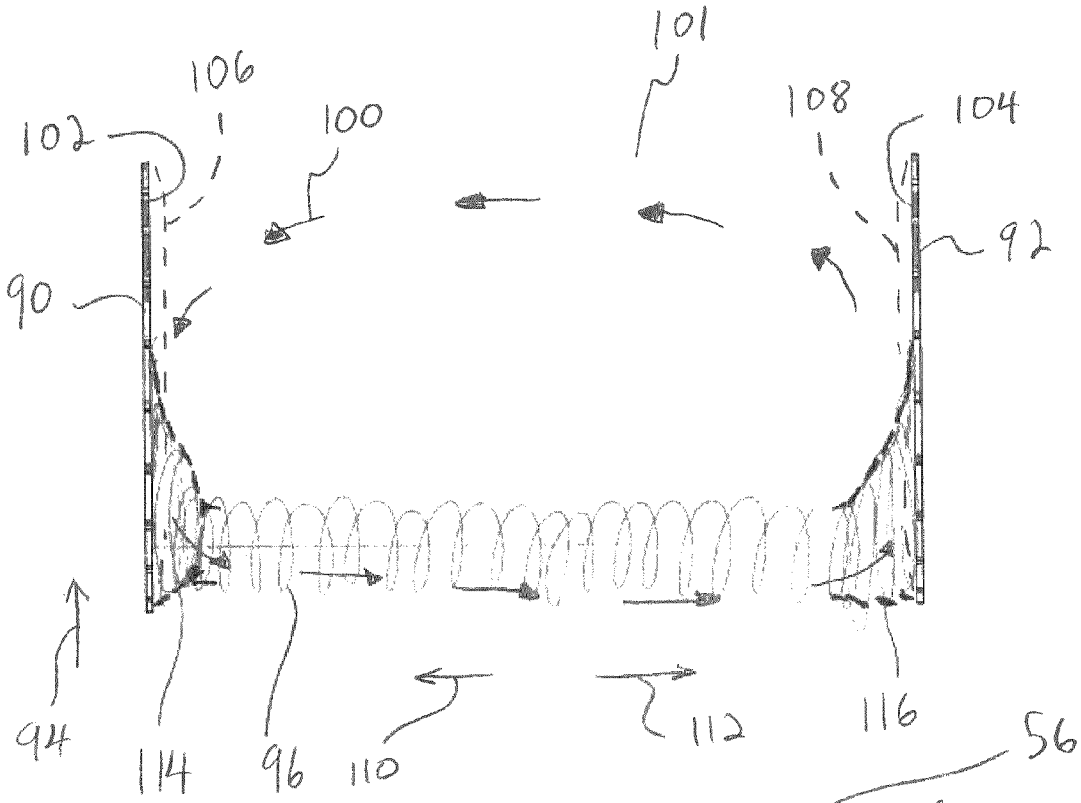
FIG. 5 is a schematic view showing air flow within a fan having blade support discs without interrupters.
Figure 6:
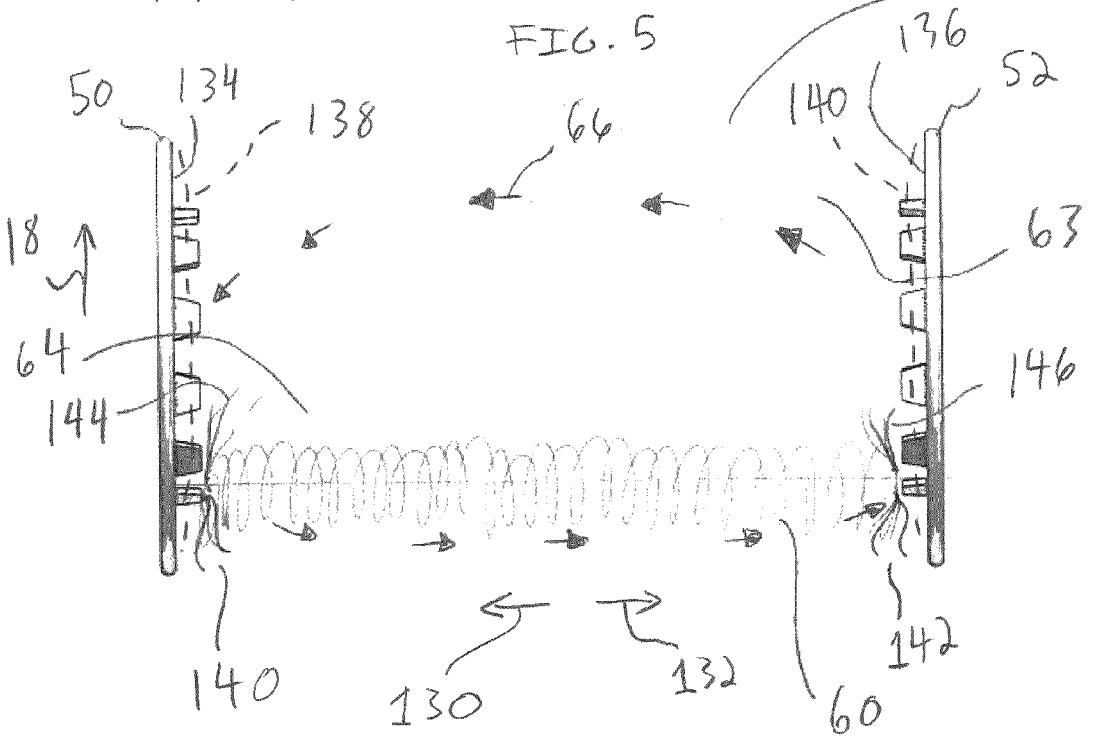
FIG. 6 is a schematic view similar to FIG. 5 showing discs of the fan of FIG. 3 with interrupters and the corresponding air flow within the fan.

With reference to FIGS. 5 and 6, further detail regarding the operation of the tabs 72 is provided. In FIG. 5, a pair of blade support discs 90, 92 are shown that are similar to the discs 50, 52, 54 except that the discs 90, 92 do not include the tabs 72 or openings 77. The discs 90, 92 are part of a cross flow fan similar to the fan 14 and the discs 90, 92 rotate within a housing similar to the housing 12 discussed above. For clarity purposes, only the discs 90, 92 are shown which define in part an interior space 101 similar to the interior space 56 (see FIGS. 4 and 6).

With continued reference to FIG. 5, rotation of the discs 90, 92 in direction 94 (and the blades supported thereon) produce an eccentric vortex 96 similar to the vortex 60. In addition to the eccentric vortex 96, the rotation of the discs 90, 92 may produce flow including laminar boundary layers 106, 108 across faces 102, 104 of the discs 90, 92. Components of the eccentric vortex 96 may travel in directions 110, 112 toward the disc faces 102, 104 and interact with the flow from the discs 90, 92 at near-disc regions 114, 116. The vortex-disc flow interaction changes rapidly and unpredictably in direction and magnitude which creates unstable air loading on the fan associated with the discs 90, 92. Further, the interaction of the flow induced by the rotating discs 90, 92 and the eccentric vortex 96 creates pressure differentials across the disc faces 102, 104 and produces secondary flow 100 within the fan that also creates unstable air loading on the fan.

With respect to FIG. 5, the motor rotating the discs 90, 92 is of a conventional type for blower assemblies having cross flow fans. To accommodate for changing air loads due to the vortex-disc airflow and the secondary flow 100, the conventional motor associated with discs 90, 92 will change the torque and speed of rotation of a drive shaft of the motor. However, when the motor rotating the discs 90, 92 changes its torque and speed, the blades on the discs 90, 92 spin faster or slower which produces an audible revving up or slowing down of the fan. Further, because the interaction of the vortex-disc airflow oscillates rapidly and unpredictably in direction and magnitude, the motor driving the discs 90, 92 may need to speed up and slow down repeatedly during operation to accommodate for the changing air load. The speeding up and slowing down of the discs 90, 92 (and fan blades thereon) may cause the blades to repeatedly produce revving up and slowing down audible tones which may be undesirable to a person in proximity to the blower assembly having the discs 90, 92 and conventional motor.

With reference to FIG. 6, a schematic view of the discs 50, 52 with the discs 72 is shown to illustrate the impact of the tabs 72 on the airflow within the fan 14. As the discs 50, 52 and blades 30 (not shown in FIG. 6) rotate in direction 18, the fan 14 produces the eccentric vortex 60. Like the discs 90, 92, rotation of the discs 50, 52 produces flow including laminar boundary layers 138, 140 near the faces 134, 136 of the discs 50, 52. Components of the vortex 60 may travel in directions 130, 132 toward faces 134, 136 of the discs 50, 52 and interact with the boundary layers 134, 136 at near-disc regions 140, 142. The interaction between the vortex 60 and the flow induced by the rotating discs 50, 52 varies rapidly in direction and magnitude and causes instability of the air load on the motor 16. Further, the interaction between the vortex 60 and the flow induced by the rotating discs 50, 52 produces pressure gradients across the discs 50, 52 that cause a secondary flow 66 within the fan interior space 56.

However, the tabs 72 of the discs 50, 52 rotate into the near-disc regions 140, 142 and disrupt the interaction between the vortex 60 and the flow induced by rotation of the discs 50, 52, as shown in FIG. 6. More specifically, the movement of the tab 72 through the near-disc regions 140, 142 decouples the vortex 60 from the flow induced by the rotation of the discs 50, 52 and introduces turbulence 144, 146 in the near-disc regions 140, 142. This turbulence 144, 146 reduces the effect of the unstable, rapidly changing vortex-disc flow interaction on the airflow in the fan 14, which stabilizes the air loading on the motor 16. This turbulence 144, 146 also reduces the magnitude of the pressure gradients across the disc faces 134, 136 and reduces the strength of the secondary flow 66, which further stabilizes airflow in the fan 14 (as shown by the shorter arrows of the flow 66 when compared to the arrows 100 in FIG. 5).

Because the air loading on the motor 16 is more stable, the motor 16 experiences less frequent and smaller magnitude changes in the air load. The motor therefore needs to adjust its torque and speed less frequently and with smaller changes in speed of the fan 14. In this manner, the fan 14 produces fewer human-audible instances of revving up and slowing down of the fan 14 than in some conventional blower assemblies.

With reference to FIGS. 7-10, the discs 50, 52 will be described in greater detail. It is noted that the disc 54 may be similar to the disc 52 (see FIG. 7A) and vary only in the configuration of an opening 150 (see FIG. 3) configured to receive a hub 152 that connects to the motor 16. With reference to FIG. 7, the disc 50 has a number of blade attachment points, such as slots 154, for supporting the blades 30. An outer edge 156 of the disc 50 may be rolled to capture the blades 30 within the slots 154. The edge 156 of disc 50 is shown rolled in FIG. 7, which would occur after the blades 30 have been positioned in the slots 154. By contrast, the edge 158 of the disc 52 is shown in FIG. 7A before being rolled.

Returning to FIG. 7, the tabs 72A, 72B have leading edges 160, 162 and trailing edges 164, 166. The leading and trailing edges of the tabs 72, as well as the cross section of the tabs 72, may be configured to impart a predetermined effect on the air flow in the near-disc region 140 (see FIG. 6). For example, the leading edges 160, 162 may have a relatively flat, blunt surface for disrupting air flow in the near-disc region 140 and generating turbulence.

As shown in FIGS. 6 and 7, rotating the disc 50 in direction 18 about the axis of rotation 70 causes the tabs 72A, 72B to sequentially pass through the near-disc region 140 and impart turbulence on the vortex-disc interaction. As shown in FIG. 7, the disc 50 has a gap 170 separating the tabs 72A, 72B. The movement of the tab 72A through the near-disc region 140, followed by the gap 170, followed by tab 72B may generate a pulse-like introduction of turbulence into the near-disc region 140 with rotation of the disc 50.

Figure 7A:
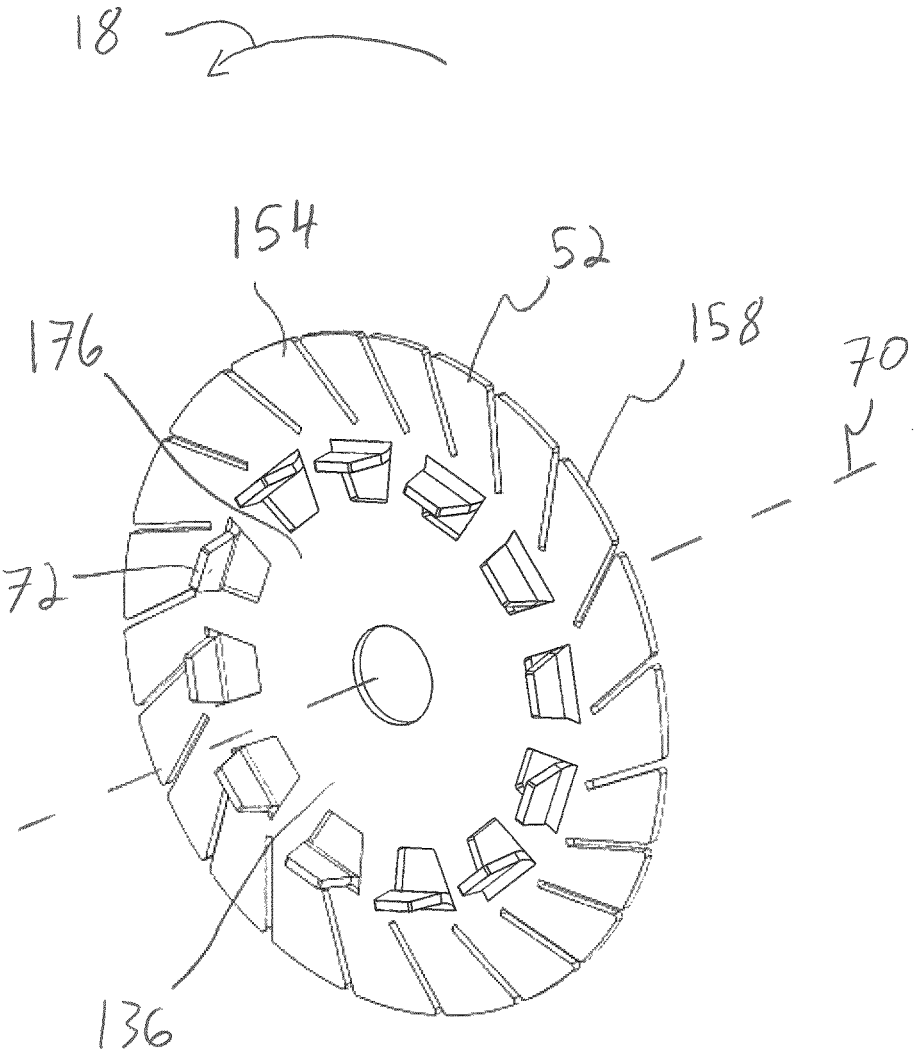
FIG. 7A is a perspective view of the middle disc of the fan of FIG. 3.

With reference to FIG. 7A, it is noted that the disc 52 (as well as the disc 54) have a similar orientation of the tabs 72 about the disc 52 as in the disc 50. However, the slots 154 of the discs 52, 54 are oriented to extend into somewhat counterclockwise manner whereas the slots 54 of the disc 50 are angled in a somewhat clockwise manner. The different orientation of the slots 154 on the discs 50, 54 is due to the discs 50, 54 being on opposite ends of the fan 14. The use of two types of discs (i.e. 50 versus 52, 54) improves the ease of manufacture of the fan 14 since only two types of discs need to be supplied to an assembly line, such as one container having discs 50 and another container having discs 52, 54 (which are similar to each other). In one form, the disc 52 may have slots 154 in a clockwise manner like the slots 154 on the disc 50. In this form, the tabs 72 of the disc 52 would extend toward the disc 54 rather than the disc 50.

Figure 8:
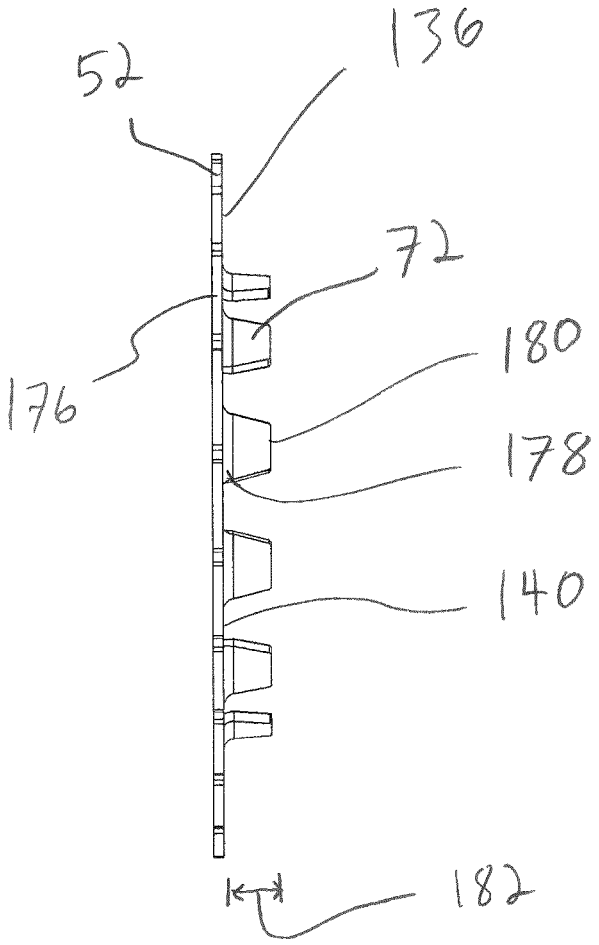
FIG. 8 is a side elevational view of the disc of FIG. 7A.
Figure 9:
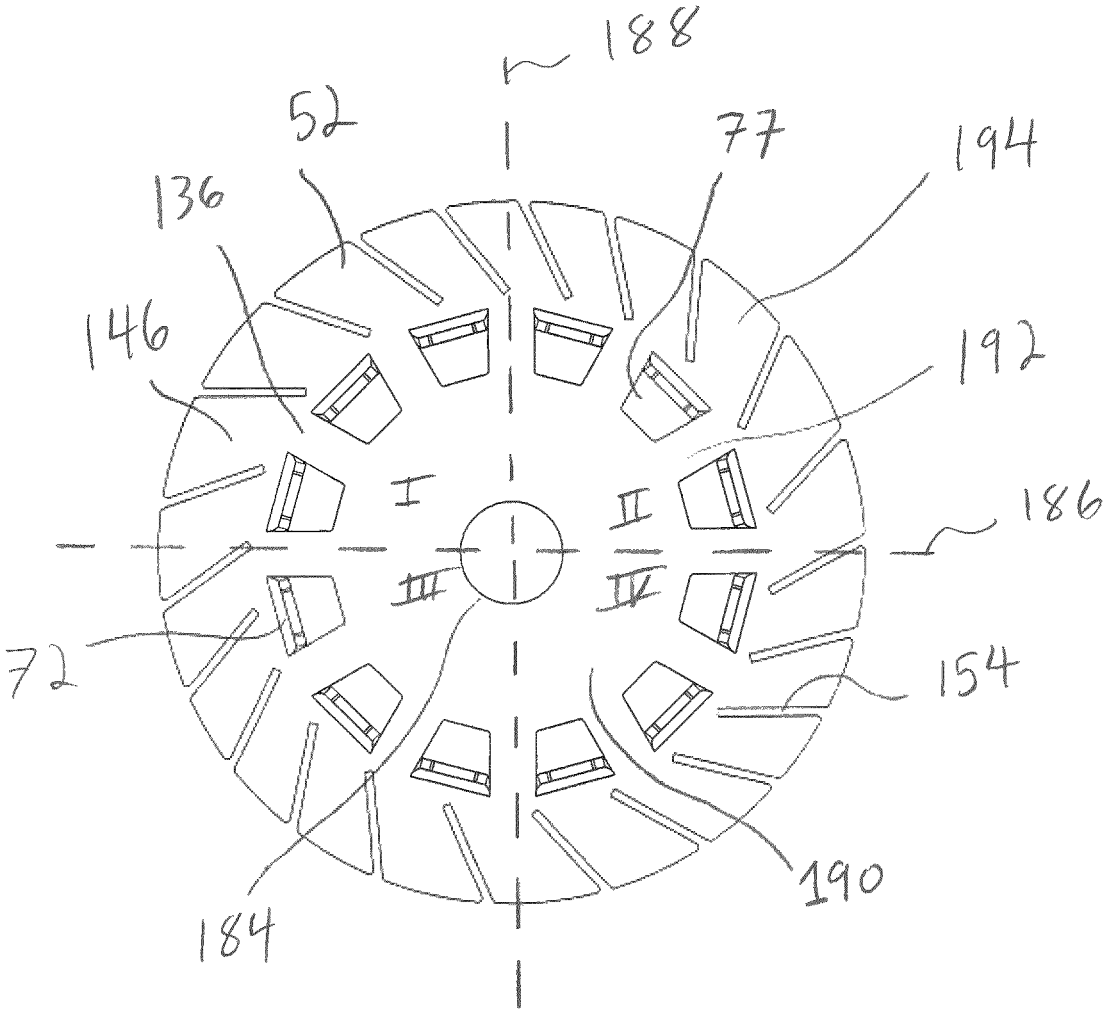
FIG. 9 is a front plan view of the disc of FIG. 7A.

With reference to FIG. 8, the disc 52 is shown having a generally planar body 176 and the tabs 72 extend transversely to the face 136 of the disc 52. The tabs 72 extend a distance 182 (see FIG. 8) away from the face 136 to provide a desired amount of disruption into the near-disc region 142 (see FIG. 6). With reference to FIG. 9, the disc 52 has a center opening 184 and axes of symmetry 186, 188 for the tabs 72 on the disc 52. The tabs 72 are evenly spaced approximately 33.3 degrees apart from each other in the quadrants I, II, III, IV of the disc 52 as shown in FIG. 9. The tabs 72 have base portions 178 at the face 136 and end portions 180 spaced away from the face 136. In one form, the disc 52 has an outer diameter in the range of approximately 2.0 inches to approximately 3.0 inches, preferably approximately 2.64 inches, and the tabs 72 have a height in the range of approximately 0.1 inches to approximately 0.3 inches, preferably approximately 0.185 inches.

With reference to FIG. 9, the disc 52 has an inner region 190 with the center opening 184. For the discs 50, 54, the inner region 190 may also include one or more openings for attaching the discs 50, 54 to a bearing or a motor mount. For example and with reference to FIG. 7, the disc 50 may have openings 191A, 191B sized to receive fasteners or other members for securing a bearing mount in the opening 184 of the disc 50. Returning to FIG. 9, the disc 52 has an outer region 194 with attachment points, such as slots 154, for being connected to the blades 30 of the fan 14. The disc 52 also has an intermediate region 192 with the opening 77 and the tabs 72 thereon. In one form, the openings 77 are formed by cutting a periphery of the tab 72 into the disc 52 and bending the tab 72 to extend transversely to the disc face 136 as discussed in greater detail below. In this approach, the openings 77 are formed at the base of the tab 72. It will be appreciated, however, that the tab 72 may be separate from the disc 52 and attached, such as by welding or fasteners, to the body 176 of the disc. This would allow the openings 77 to be formed independently of the tab 72 such that the openings 70 may be positioned closer to or away from the center opening 184 and may have a shape unrelated to the tab 72. In another embodiment, the openings 77 are formed laterally about the disc 52 from the tabs 72 rather than being aligned along a radius of the disc 52 with the openings 77.

Figure 10:
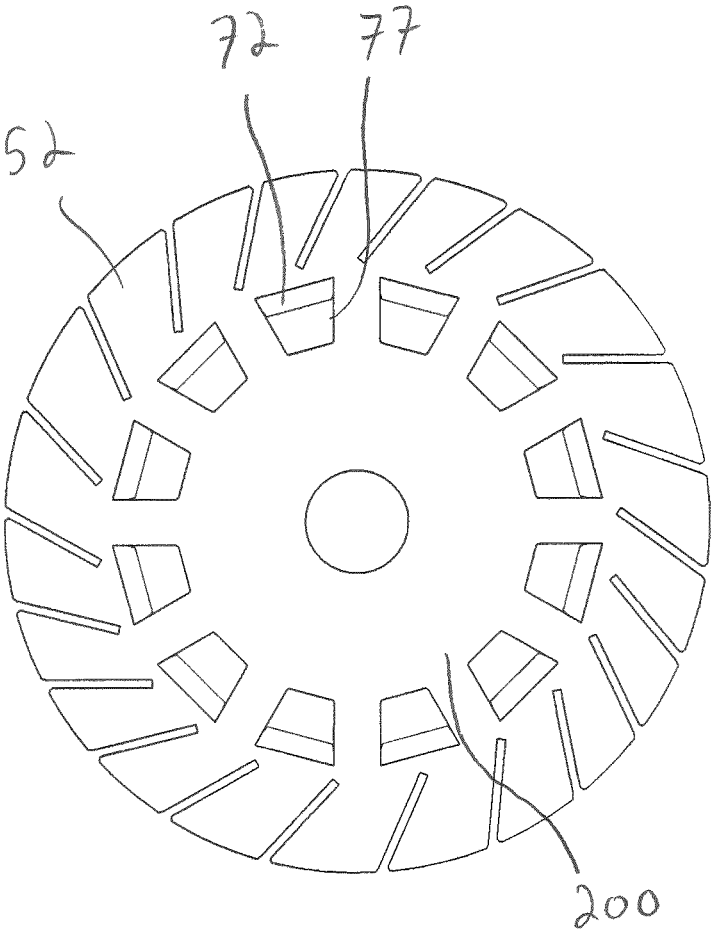
FIG. 10 is a rear plan view of the disc of FIG. 7A.

With reference to FIG. 10, an opposite side of the disc 52 is shown than is shown in FIG. 9. The disc 52 has an opposite face 200 and the openings 77 extend between the face 136 and the face 200. Because the through openings 77 extend between the faces 136, 200, the tabs 72 are visible as viewed from the rear face 200.

Figure 11:
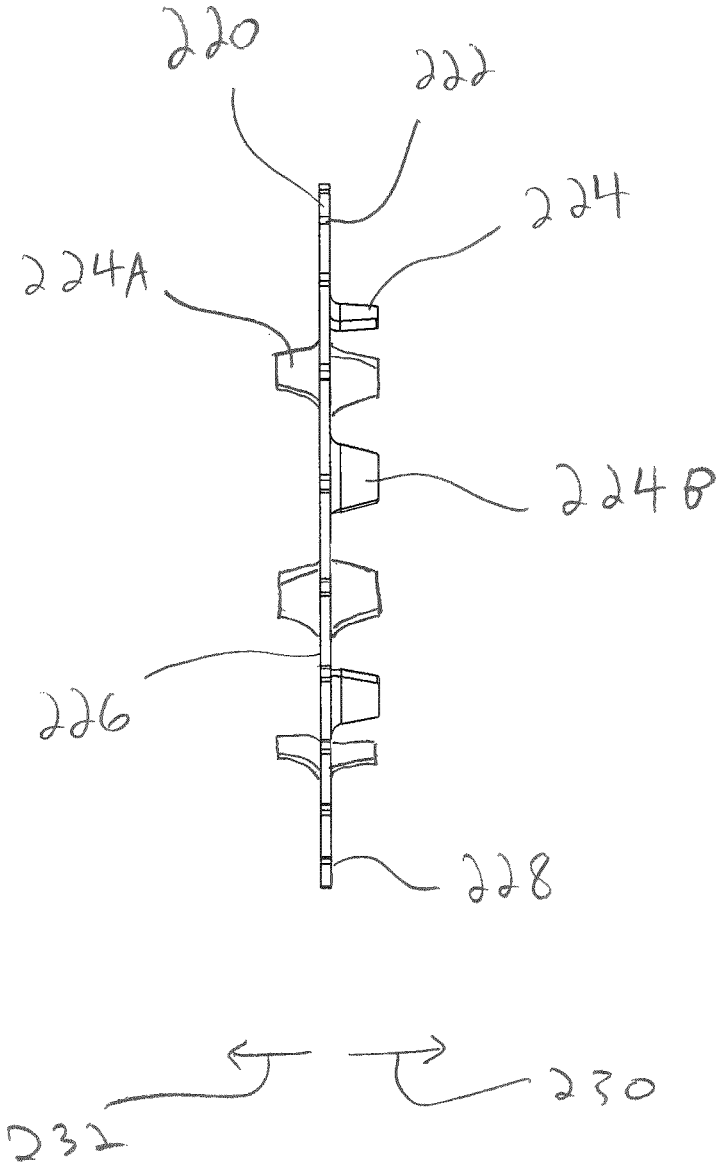
FIG. 11 is a side elevational view of another embodiment of a blade support disc.

With reference to FIG. 11, a disc 220 shown that is an alternative form of the disc 52 discussed above. With reference to FIG. 11, the disc 220 has slots 222 with similar orientation as the slots 154 of the disc 52. The disc 220 is also similar to the disc 52 in that the disc 220 has the same number of tabs 224 as the tabs 72 on the disc 52. However, the disc 220 has half of its tabs 224A extending away from one face 226 of the disc 220 and the other half of its tabs 224B extending away from an opposite face 228 of the disc 220. As discussed in greater detail below, the tabs 224A, 224B may be formed by bending every other tab 224 in direction 230 out of the plane of the disc 220 (which forms tabs 224) and then pressing the remaining tabs 224 out of the plane of the disc 220 in direction 232 (which forms tabs 224A). By utilizing the disc 220, the tabs 224B may interrupt the vortex-disc flow interaction in the space 58 (see FIG. 4) while the tabs 224A interrupt the vortex-disc flow interaction in the space 56.

Figure 12:
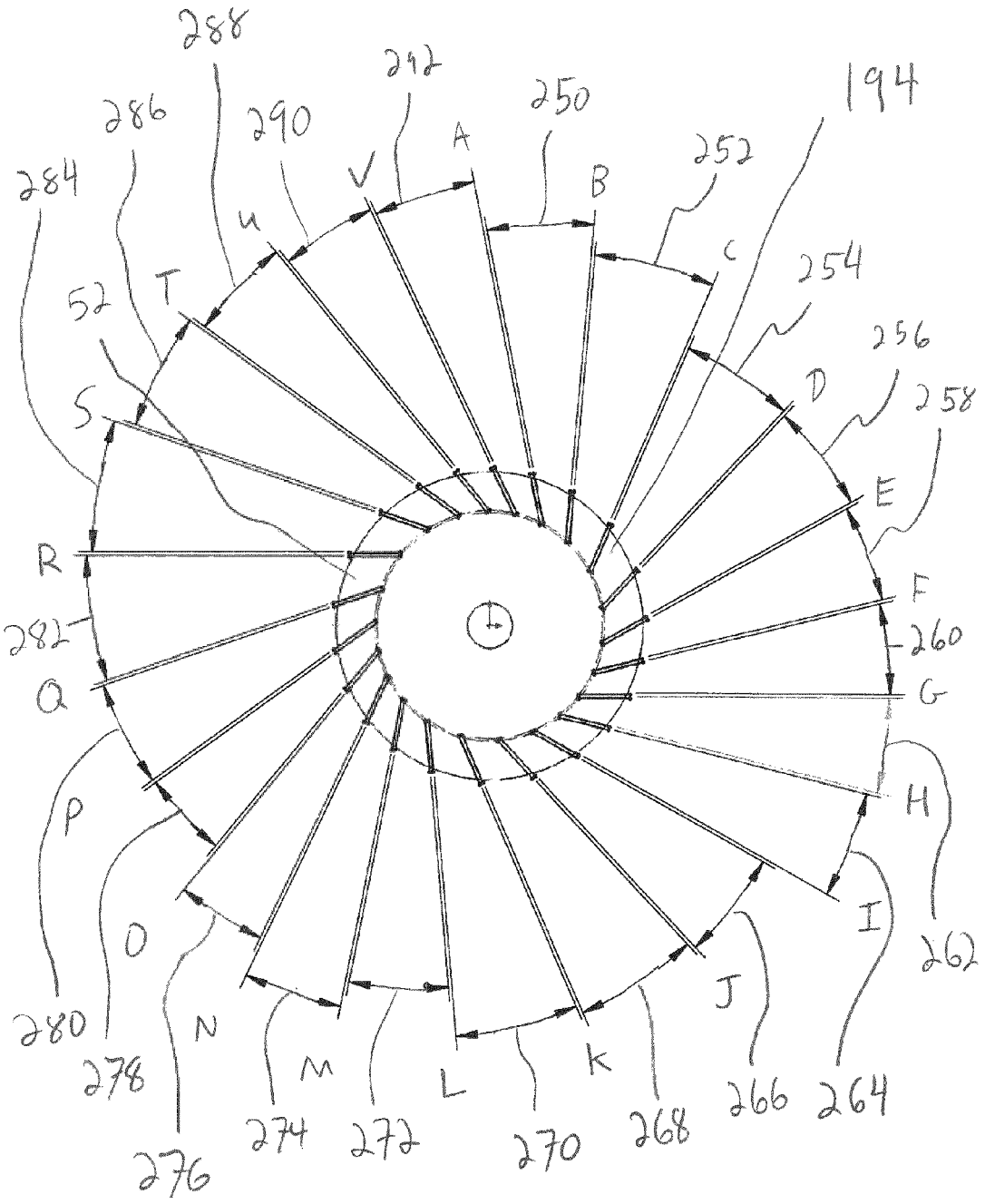
FIG. 12 is a schematic view of one of the discs of the fan of FIG. 3 showing relative spacing between blade attachment points on the disc.

With reference to FIG. 12, the peripheral region 194 of the disc 52 is shown with the slots 154 identified using letters A-V. In one form, the slots A-V are oriented about the disc 52 to have an uneven spacing between the slots A-V. The uneven spacing of the slots A-V, and the blades 30 attached thereto, reduces the sharp airflow gradients near the cutoff 45 as the blades 30 travel past the cutoff 45. The uneven spacing of the slots A-V, and the blades 30 connected thereto, thereby reduces high-pitch operating noises from the blower assembly 10 such as whine or whistling sounds produced by some conventional blower assemblies with evenly spaced fan blades.

The uneven spacing of the slots A-V may be determined according to a pattern or an equation such as a sinusoidal equation. In another approach, the spacing between the slots A-V may be random. With reference to FIG. 12, the disc 52 has the following angles between the slots A-V.

| Reference Numeral | Angular Spacing |
|---|---|
| 250 | In the range of approximately 15.1 degrees to approximately 17.1 degrees, preferably approximately 16.1 degrees |
| 252 | In the range of approximately 17.5 degrees to approximately 19.5 degrees, preferably approximately 18.5 degrees |
| 254 | In the range of approximately 18.4 degrees to approximately 20.4 degrees, preferably approximately 19.4 degrees |
| 256 | In the range of approximately 16.8 degrees to approximately 18.8 degrees, preferably approximately 17.8 degrees |

-continued

| Reference Numeral | Angular Spacing |
|---|---|
| 258 | In the range of approximately 14.4 degrees to approximately 16.4 degrees, preferably approximately 15.4 degrees |
| 260 | In the range of approximately 12.9 degrees to approximately 14.9 degrees, preferably approximately 13.9 degrees |
| 262 | In the range of approximately 12.9 degrees to approximately 14.9 degrees, preferably approximately 13.9 degrees |
| 264 | In the range of approximately 14.4 degrees to approximately 16.4 degrees, preferably approximately 15.4 degrees |
| 266 | In the range of approximately 16.8 degrees to approximately 18.8 degrees, preferably approximately 17.8 degrees |
| 268 | In the range of approximately 18.4 degrees to approximately 20.4 degrees, preferably approximately 19.4 degrees |
| 270 | In the range of approximately 17.5 degrees to approximately 19.5 degrees, preferably approximately 18.5 degrees |
| 272 | In the range of approximately 15.1 degrees to approximately 17.1 degrees, preferably approximately 16.1 degrees |
| 274 | In the range of approximately 13.3 degrees to approximately 15.3 degrees, preferably approximately 14.3 degrees |
| 276 | In the range of approximately 12.8 degrees to approximately 14.8 degrees, preferably approximately 13.8 degrees |
| 278 | In the range of approximately 13.7 degrees to approximately 15.7 degrees, preferably approximately 14.7 degrees |
| 280 | In the range of approximately 15.9 degrees to approximately 17.9 degrees, preferably approximately 16.9 degrees |
| 282 | In the range of approximately 18.1 degrees to approximately 20.1 degrees, preferably approximately 19.1 degrees |
| 284 | In the range of approximately 18.1 degrees to approximately 20.1 degrees, preferably approximately 19.1 degrees |
| 286 | In the range of approximately 15.9 degrees to approximately 17.9 degrees, preferably approximately 16.9 degrees |
| 288 | In the range of approximately 13.7 degrees to approximately 15.7 degrees, preferably approximately 14.7 degrees |
| 290 | In the range of approximately 12.8 degrees to approximately 14.8 degrees, preferably approximately 13.8 degrees |
| 292 | In the range of approximately 13.3 degrees to approximately 15.3 degrees, preferably approximately 14.3 degrees |

The spacing between the slots A-V varies sinusoidally according to the following equation:

$$\theta i = \frac{360}{N + BA\cos\left[\frac{2\pi B}{N}(i - .5)\right]}$$

Where:
N=22 blades
B=3 cycles
A=1.27
C=0.5
i=incremental blade number

The equation above provides the incremental angles between the slots A-V. However, the slot angles do not add up to exactly 360 degrees so that they must be corrected using the following equation.

$$\theta i' = \theta i \frac{360}{\sum_{1}^{N} \theta i}$$

It will be appreciated that the foregoing equations may be used to design different fans. For example, the equations may be used to determine slot angles for a different number of blades or cycles. Further, the equations may be used to determine the spacing between blades for fans that do not utilize slots to connect fan blades to blade supports (such as welding the blades to the blade supports). For these applications, the equations provide incremental angles between the blades themselves.

Figure 12A:
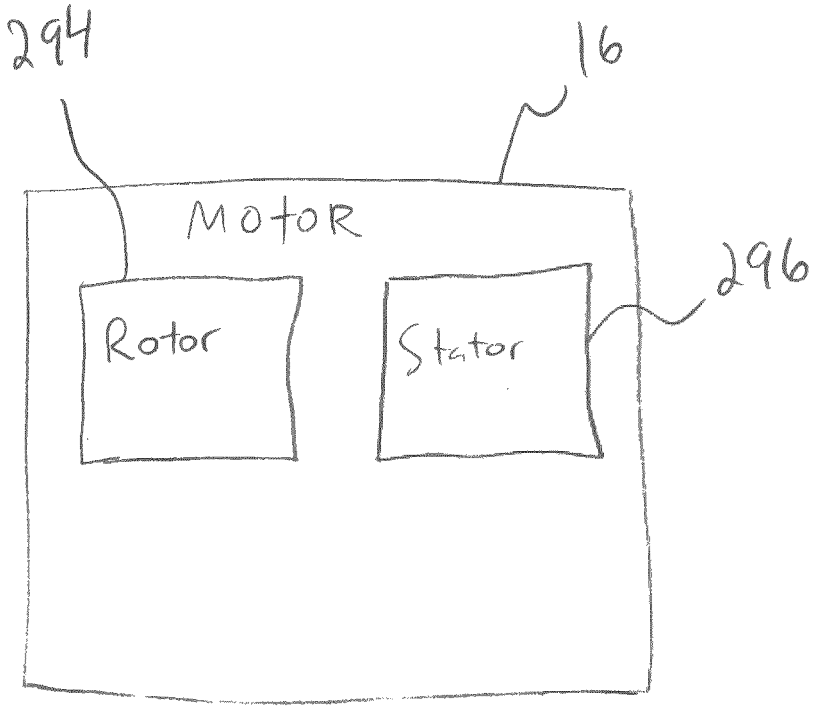
FIG. 12A is a schematic view of a motor of the blower of FIG. 1.
Figure 12B:
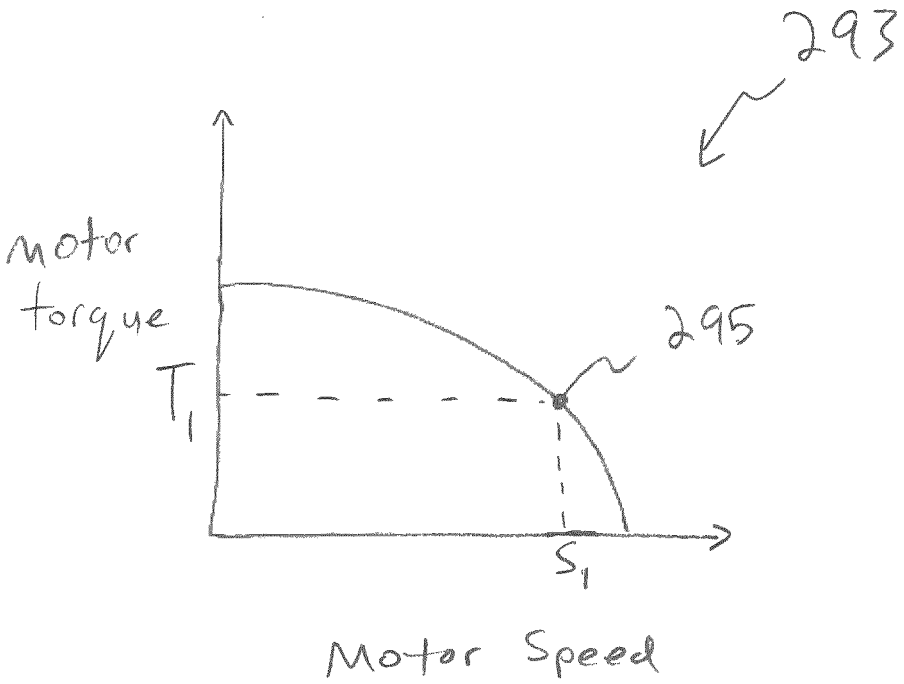
FIG. 12B is a performance curve of the motor of the blower of FIG. 1.

Turning to FIGS. 12A and 12B, the motor 16 has a rotor 294 and a stator 296. In one form, the rotor 294 is a high electrical resistance rotor that causes the motor 16 to have a characteristic speed/torque curve 293 with a downwardly sloping shape, as shown in FIG. 12B. During operation, the motor has an operating point 295 that may travel along the curve 293 depending on the friction, air resistance, etc. of rotating the fan 14. The motor 16, however, has a single speed S1 for a given torque T1 produced by the motor 16. The motor 16 compensates for changes in the air load on the motor 16 by moving to the one speed/torque satisfies the air load rather than searching between two different speed/torque combinations as in some conventional blower assemblies. In this manner, the motor 16 having the high-resistance rotor 294 reduces low-pitch operating noise of the blower assembly 10 by reducing the frequency and magnitude of changes in the speed of motor 16 (and fan 14) and the associated audible revving up and slowing down of the fan 14.

With reference to FIGS. 9 and 13-20, a method 300 is shown for producing a blade support, such as the disc 52. Initially, a piece of stock material 302 is provided. The material 302 may be, for example, a piece of sheet metal or a sheet of plastic. In one approach, the material 302 is selected from aluminum or steel.

Figure 13:
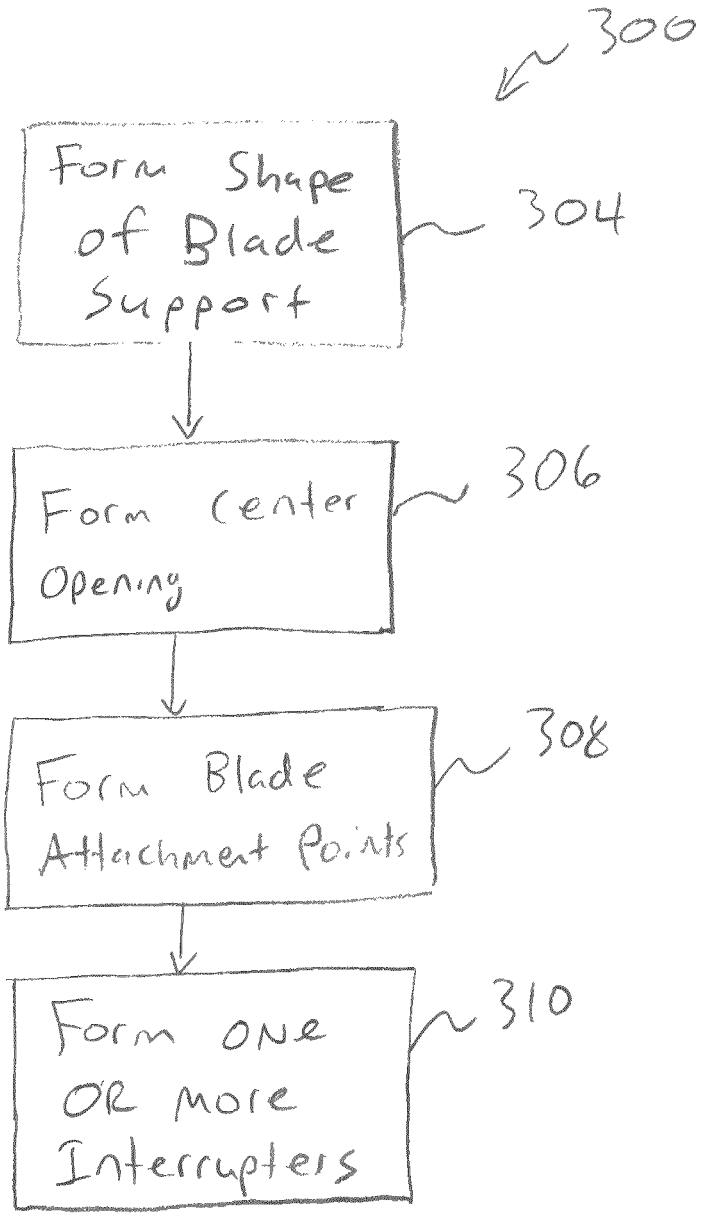
FIGS. 13-20 show a method of forming a blade support, such as the middle disc of the fan of FIG. 3.
Figure 16:
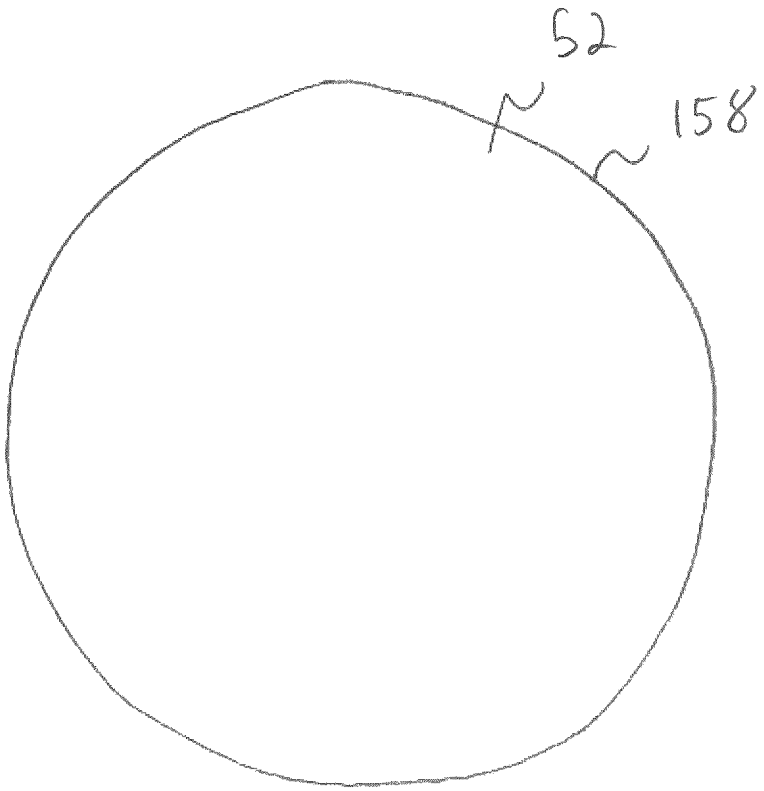
Figure 17:
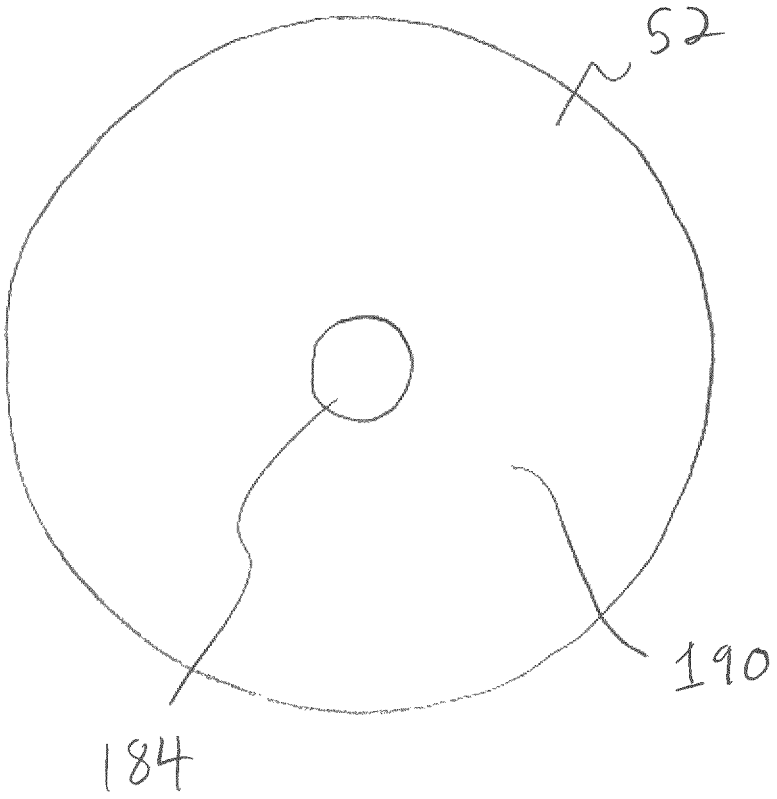

With reference to FIG. 13, the material 302 is formed 304 into the desired shape of the blade support. In this example, the material 302 is stamped into a circular disc 52 with a circular outer edge 158, as shown in FIGS. 7, 8 and 16. Another approach is that the disc shape 52 may be formed using a laser to cut the disc 52 out of the stock material 302. In other approaches, the disc 52 may be formed using metal injection or high temp plastic injection molding.

It will be appreciated that the blade support may have a shape other than a disc. For example, the blade support may be a narrow strip of material such that the blade support has an annular shape. As another example, the blade support may include first a member bent into and fixed in an annular shape, and a second member positioned to extend diametrically across the annular member. The second member may be welded or otherwise secured to the annular member and provides a mounting point for a bearing hub or motor drive shaft hub.

The method 300 includes forming 306 the center opening 184 of the disc 52. The center opening may be sized to receive, for example, a hub for connecting the disc 52 to a bearing or a drive shaft of a motor. The center opening 184 may be formed in a variety approaches such as by cutting or punching the opening 184 from the disc 52. In some approaches, the center opening 184 may not be formed in the disc 52.

As part of the forming 306 operation, the method 300 may also include forming openings in the inner region 190 of the disc. For example, when the method 300 is used to form the discs 50 and 54, the forming 306 may including forming openings 191A, 191B (see FIG. 9) in the disc 50. Similar openings 191A, 191B may be formed in the inner region 190 of the disc 54 for receiving fasteners for connecting to a motor drive shaft mount.

Figure 18:
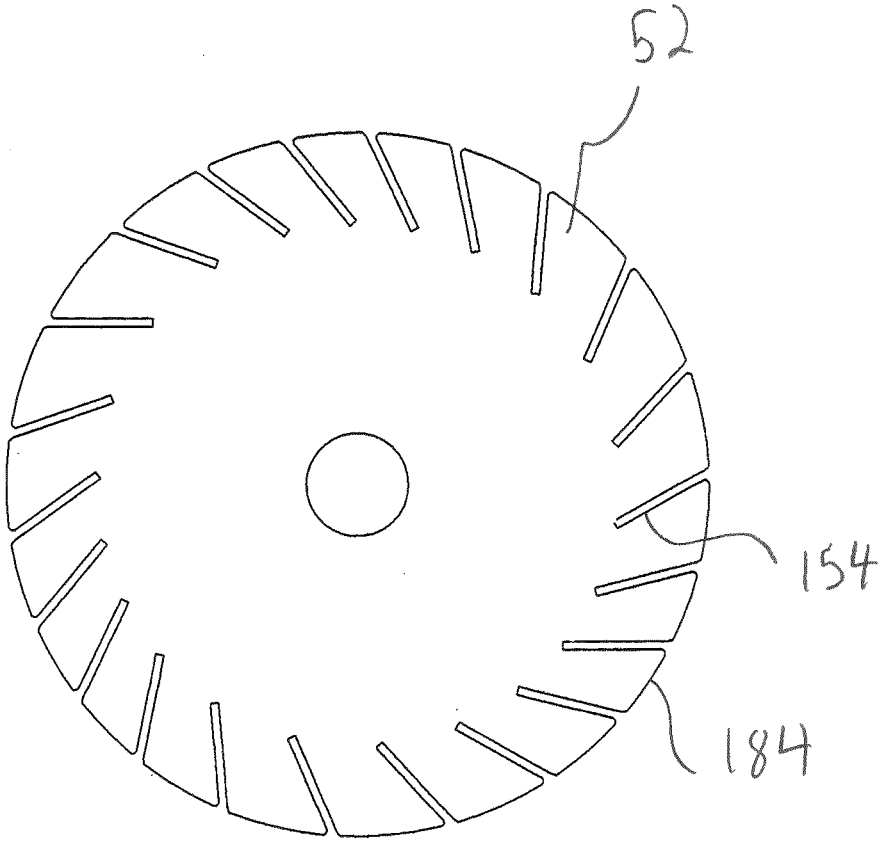

With reference to FIGS. 13 and 18, the method 300 includes forming 308 blade attachment points, such as slots 154. The slots 154 are open at the outer edge 184 of the disc 152. In an alternative approach, the slots 154 are closed at the outer edge 184 such that the blades 30 are connected to the disc 52 by advancing the blades 30 lengthwise through the slots 154 and deforming the blades 30 on opposite sides of the disc 52 to capture the disc 52 along the blades 30. In another approach, the disc peripheral region 194 does not have any openings and forming the blade attachment points 308 occurs during assembly of the corresponding fan when the ends of the blades are welded or bolted the peripheral region 194 of the disc 52.

Figure 14:
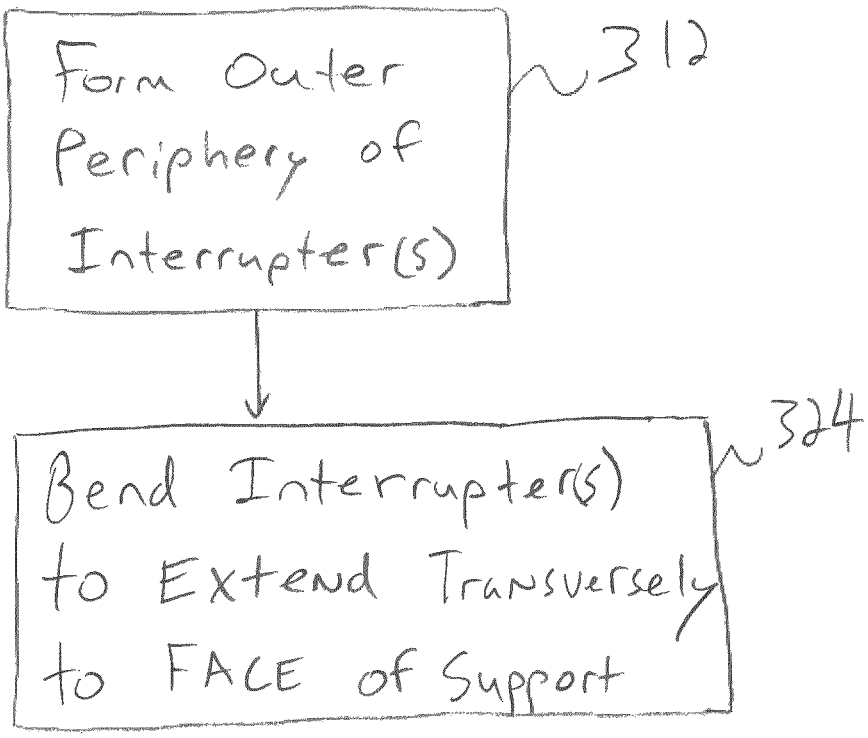
Figure 15:
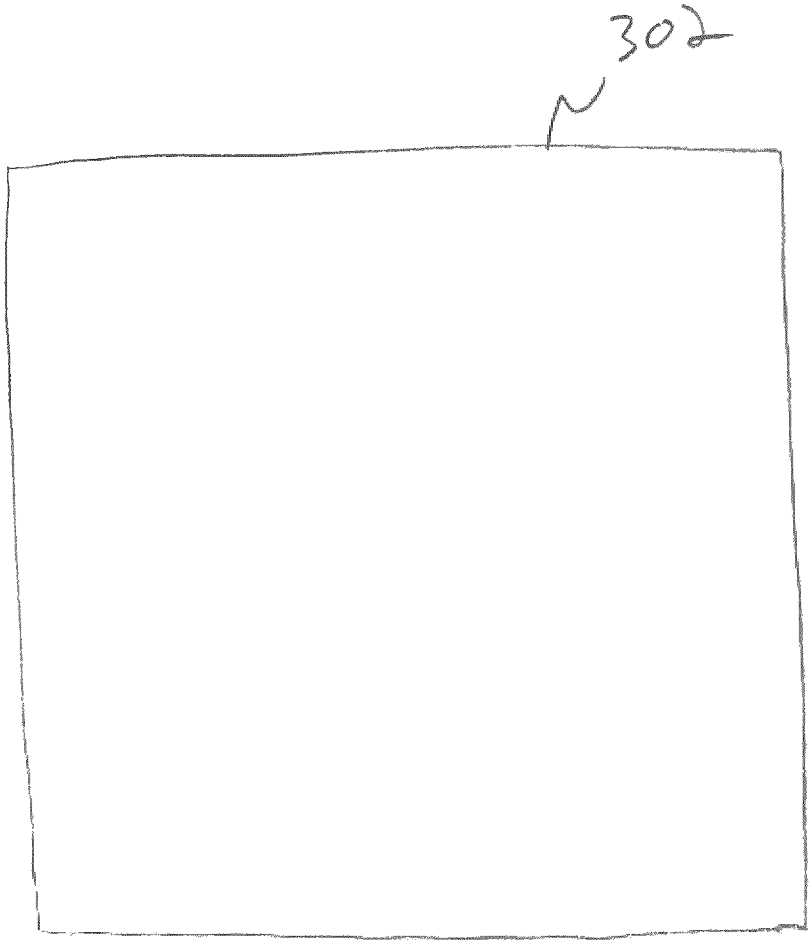
Figure 19:
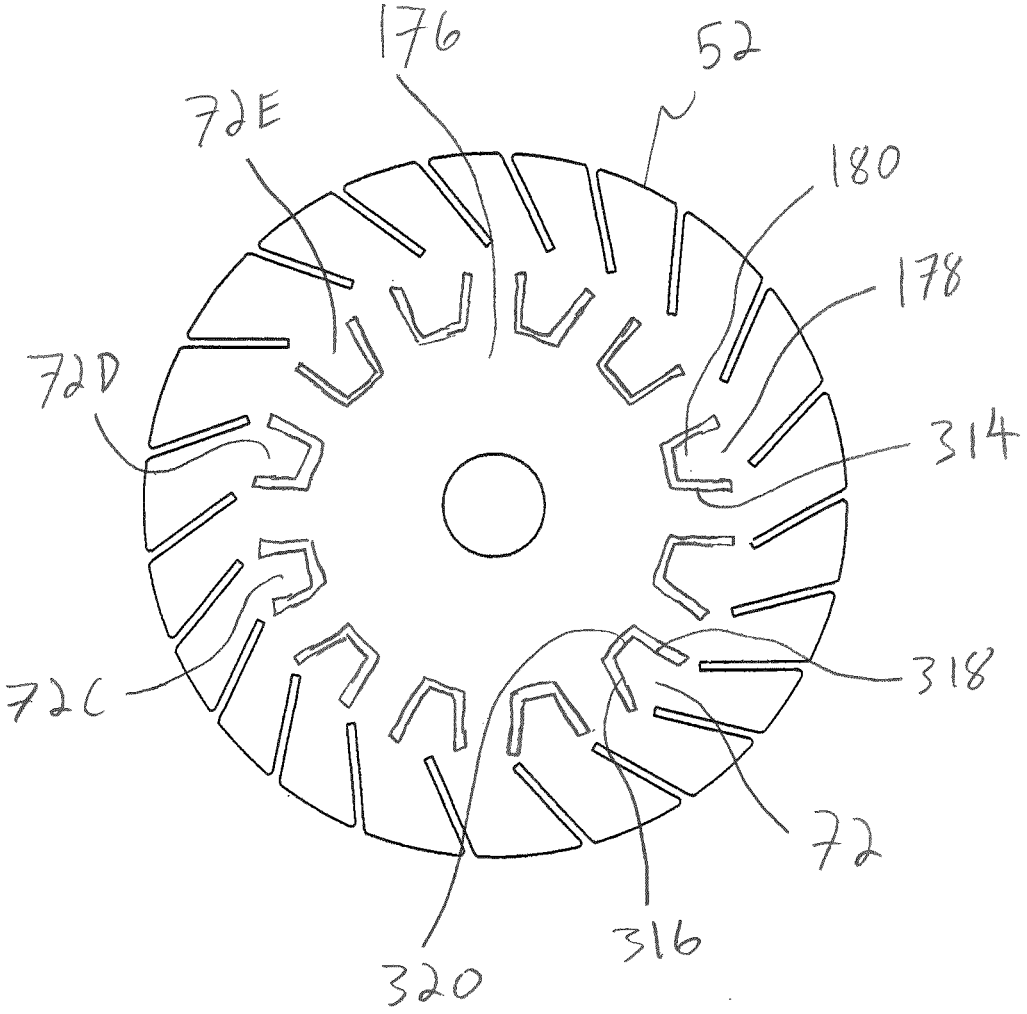

With reference to FIGS. 13 and 14, the method 300 further includes forming 310 at least one interrupter 310 of the disc 52. In one approach, forming 310 the interrupters includes forming an outer periphery of the at least one interrupter 312 in the disc 52. With reference to FIG. 19, the forming 312 of the outer periphery includes cutting a through opening 314 through the disc 52. The through opening 314 defines two side edges 316, 318 and an inner edge 320 of each of the tabs 72 of the disc 52. The openings 314 may be formed in the disc 52 using a number approaches, such as punching, plasma cutting, or laser cutting through the disc 52.

Figure 20:
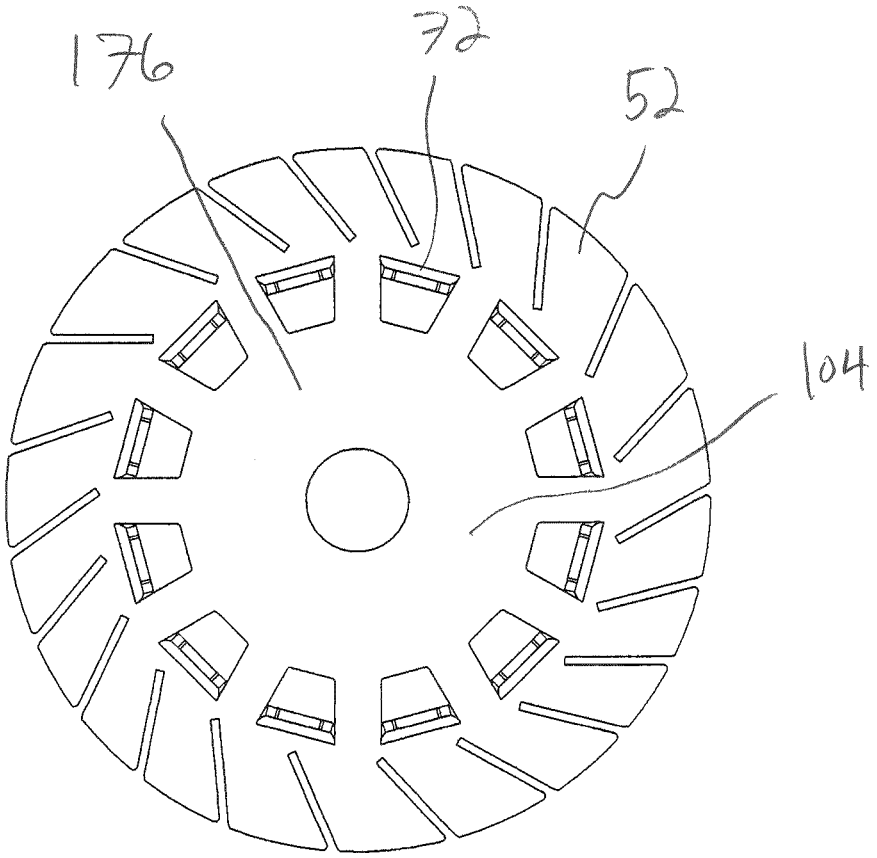

With reference to FIGS. 14 and 20, the process 300 includes bending 324 the tabs 72 to extend transversely to the face 136 of the disc 52. With reference to FIGS. 7A and 20, the tabs 72 of the disc 52 have all been bent out of the page of FIG. 20 toward the viewer. Alternatively, with reference to FIG. 19, tab 72C may be bent 324 into the page of FIG. 19, the tab 72D may be bent out of the page of FIG. 19, the tab 72E may be bent into the page of FIG. 19, and so on about the disc 52. This would result in the disc 52 having tabs 72 on alternating sides of the disc 52 in a manner similar to the disc 220 of FIG. 11. In another approach, forming 310 the at least one interrupter may not involve cutting outer profiles of the tab 72 into the disc 52. For example, the at least one interrupter of the disc 52 may include one or more ridges upstanding from the face 136 of the disc 52 that are formed by stamping the one or more ridges into the disc 10. Further, the step of forming 310 the ridge in the disc 52 and forming 306 the center opening 184 may be achieved simultaneously in a single stamping operation. In another approach, forming 310 the at least one interrupter includes attaching one or more members to the disc 52. The members may be welded or secured to the disc 52 using fasteners, for example.

Figure 21:
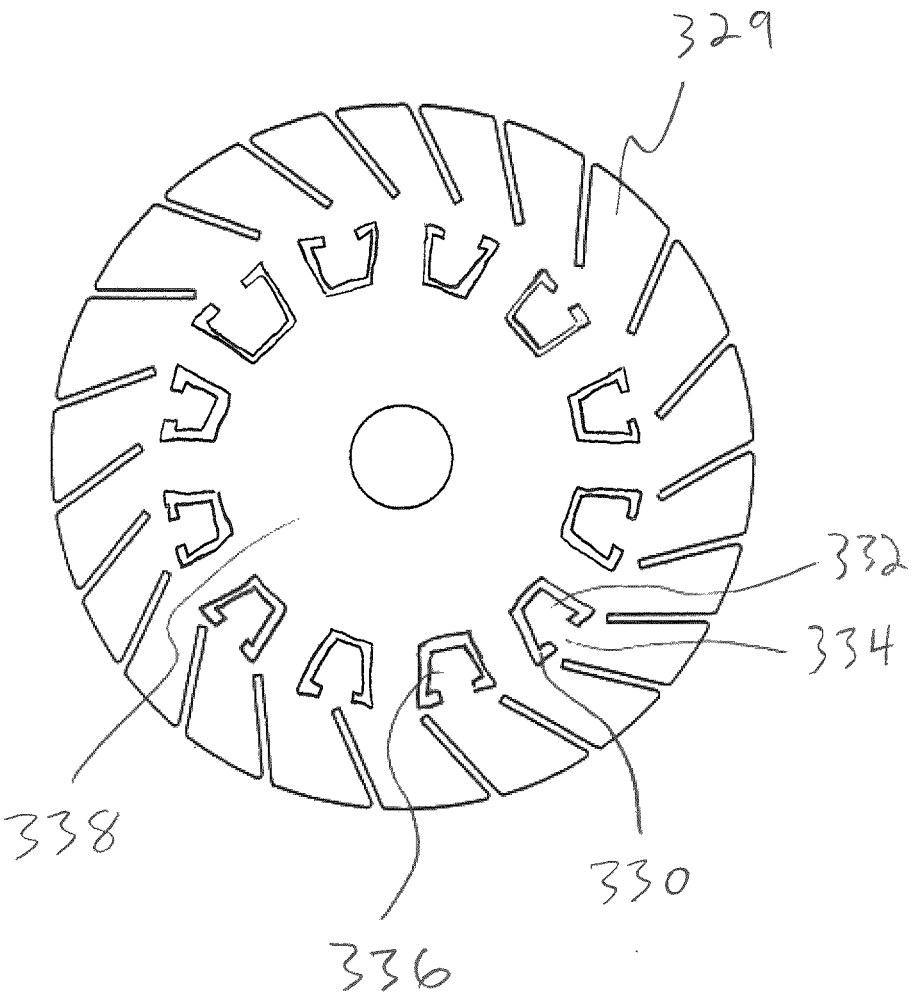
FIG. 21 is a plan view of another disc that may be formed using the method of FIGS. 13-20.

With reference to FIG. 21, an alternative approach for forming 312 an outer periphery of the at least one interrupter of a blade support 329 is shown. With reference to FIG. 21, through openings 330 are formed in the disc 329 and the through openings 330 generally define a head 330 and a neck 334 of tabs 336. The neck 334 is thinner than the base portion 178 of the tabs 72 (see FIG. 19) of the disc 52 which may make it easier to bend the head 332 of the tabs 336 to extend transversely to a face 338 of the disc 52 than bending the tab 72 to extend transversely to the face 136 of the disc 52.

Although the method 300 has been described in a particular order of operations, it will be appreciated that the operations may be modified, combined, removed, or performed in a different order than the order presented. Further, additional or fewer actions may be performed at each operation without departing from the teachings of this disclosure.

Figure 22:
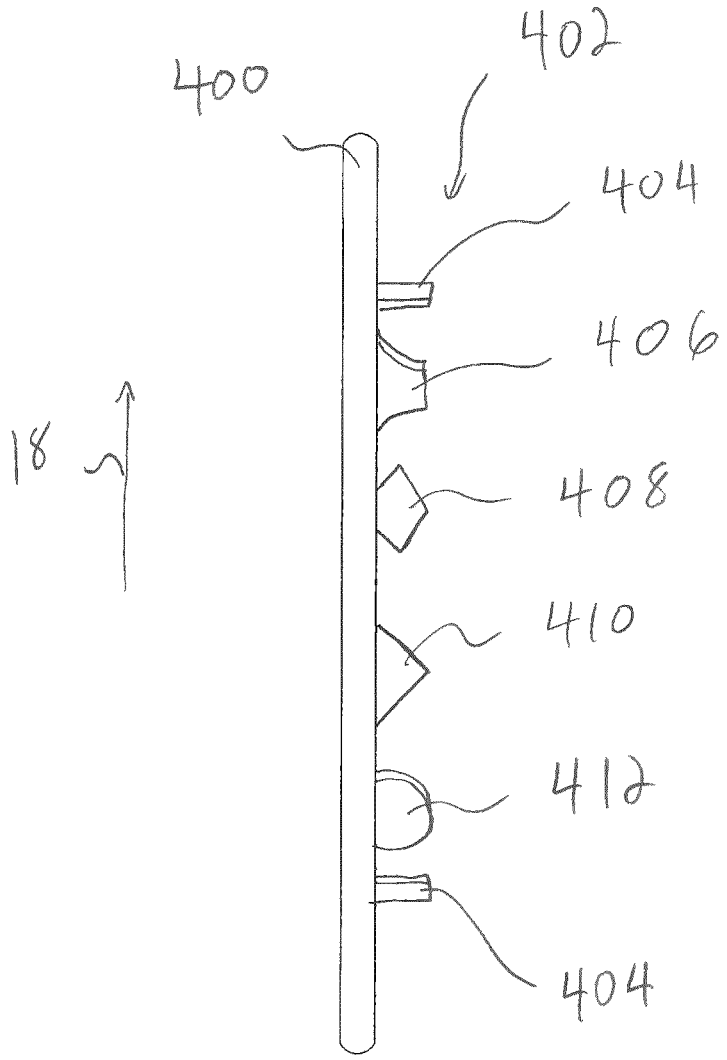
FIG. 22 is a side elevational view of another embodiment of a blade support disc.

With reference to FIG. 22, another blade support 400 is shown. The blade support 400 has a number of flow interrupters 402 having different shapes. The interrupters 402 include rectangular members 404, a generally volcano-shaped member 406, a diamond-shaped member 408, a triangle-shaped member 410, and a circular member 412.

Figure 23:
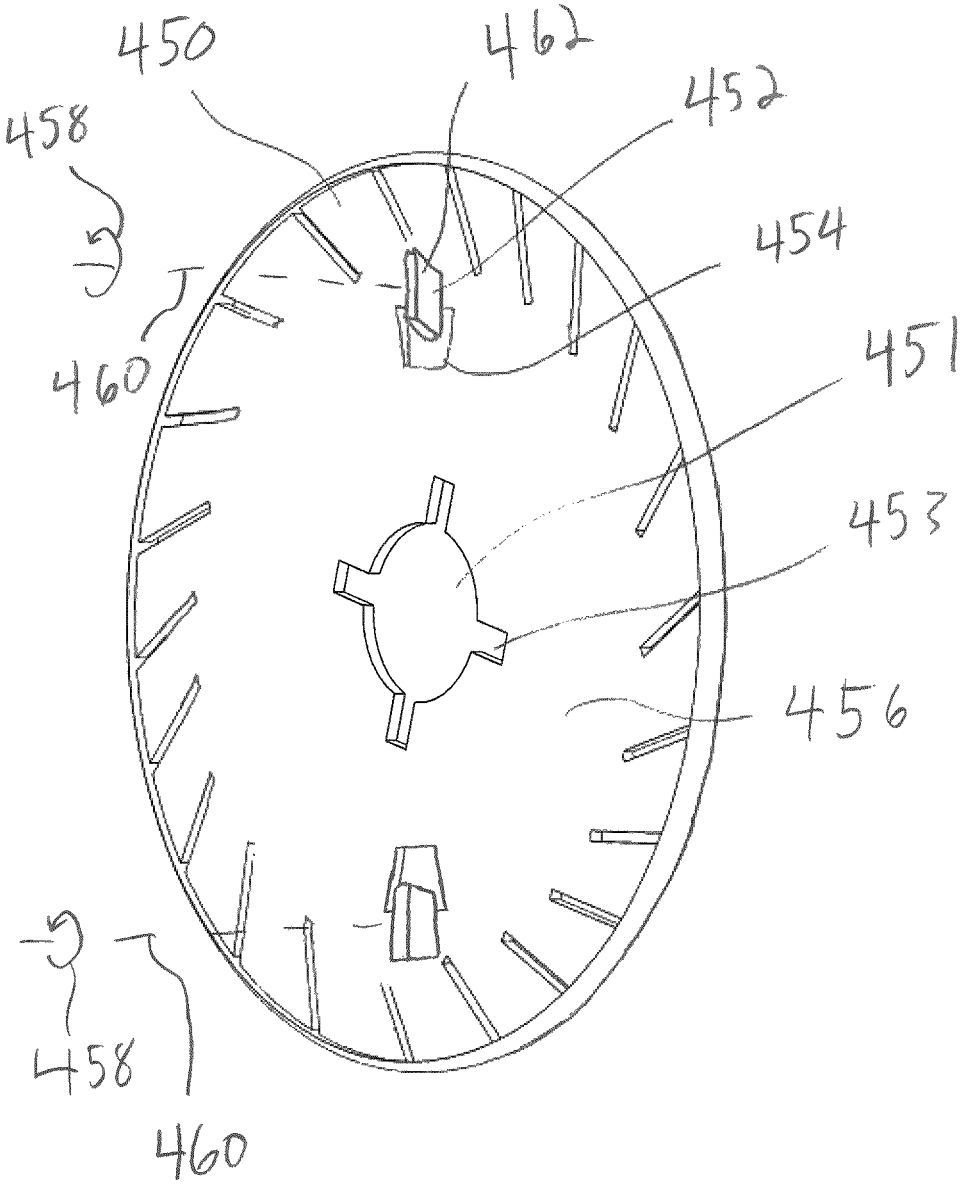
FIG. 23 is a perspective view of another embodiment of a blade support disc.

With reference to FIG. 23, another blade support 450 is shown. The blade support 450 is similar to the disc 54 discussed above and includes a center opening 451 with slots 453 for engaging a motor drive shaft hub. The blade support 450 has two flow interrupters in the form of tabs 452 formed by cutting out profiles of the tabs 452 and bending the tabs 452 to extend transversely to a face 456 of the support 450 (which also formed openings 454). During manufacture of the blade support 450, the tabs 452 are twisted in direction 458 about respective axes 460 such that the tabs 452 are oriented to extend generally along a radius of the blade support 450. This orientation of the tabs 452 may introduce additional turbulence into the interaction between the eccentric vortex 60 and the flow induced by the disc 450 because of the paddle-like shape of surface 462 that travels through the interaction 10.

Figure 24:
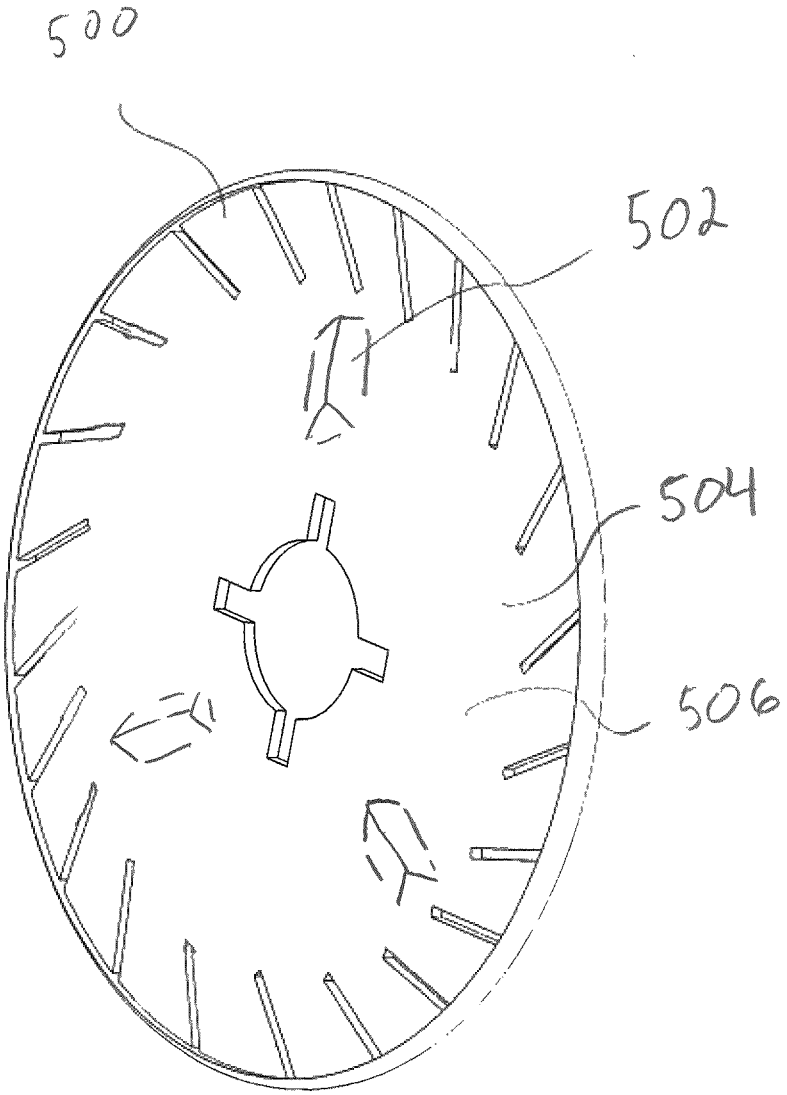
FIG. 24 is a perspective view of another embodiment of a blade support disc.

With reference to FIG. 24, another blade support 500 is shown. The blade support 500 has flow interrupters in the form of three v-shaped ridges 502 extending outward from a face 504 of the blade support 500. The ridges 502 may be formed by deforming a body 506 of the support 500, such as at step 310 in the method 300 of FIG. 13.

While the foregoing description is with respect to specific examples, those skilled in the art will appreciate that there are numerous variations of the above that fall within the scope of the concepts described herein and the appended claims.

What is claimed is:

1. A blower assembly comprising:

a housing having side walls;

a cross flow fan having a pair of opposite ends each rotatably mounted to one of the side walls of the housing with rotation of the cross flow fan driving air flow through the housing which produces an eccentric vortex of air flow in the housing;

an inlet opening of the housing extending from one side wall of the housing to another side wall and which opens to the cross flow fan;

a circular blade support of the cross flow fan that induces air flow with rotation of the cross flow fan which interacts with the eccentric vortex; and at least one tab having a base connected to the circular blade support and an unattached free end opposite the base, the entirety of the at least one tab except the base being unattached and spaced from the circular blade support, the at least one tab configured to rotate through the interaction of the eccentric vortex and the air flow induced by the circular blade support and disrupt the interaction between the eccentric vortex and the air flow induced by the circular blade support.

2. The blower assembly of claim 1 wherein the circular blade support has a generally flat face producing a laminar boundary layer with rotation of the cross flow fan and the at least one tab breaks up the laminar boundary layer with rotation of the cross flow fan.

3. The blower assembly of claim 1 wherein the at least one tab includes a plurality of tabs spaced apart about the circular blade support.

4. The blower assembly of claim 1 wherein the circular blade support includes at least one opening associated with the at least one tab.

5. The blower assembly of claim 4 wherein the at least one tab includes a plurality of tabs and the at least one opening includes an opening associated with each of the plurality of tabs.

6. The blower assembly of claim 1 further comprising an electric motor having a high electrical resistance rotor.

7. The blower assembly of claim 1 wherein the cross flow fan includes a plurality of blades attached to the circular blade support at locations unevenly spaced about the circular blade support.

8. The blower assembly of claim 1 wherein the cross flow fan includes twenty-two blades spaced about the circular blade support by an uneven angular displacement between adjacent blades, the angular displacement of the blades including:

a first angular displacement of approximately 16.1 degrees;

a second angular displacement of approximately 18.5 degrees;

a third angular displacement of approximately 19.4 degrees;

a fourth angular displacement of approximately 17.8 degrees;

a fifth angular displacement of approximately 15.4 degrees;

a sixth angular displacement of approximately 13.9 degrees;

a seventh angular displacement of approximately 13.9 degrees;

an eighth angular displacement of approximately 15.4 degrees;

a ninth angular displacement of approximately 17.8 degrees;

a tenth angular displacement of approximately 19.4 degrees;

an eleventh angular displacement of approximately 18.5 degrees;

a twelfth angular displacement of approximately 16.1 degrees;

a thirteenth angular displacement of approximately 14.3 degrees;

a fourteenth angular displacement of approximately 13.8 degrees;

a fifteenth angular displacement of approximately 14.7 degrees;

a sixteenth angular displacement of approximately 16.9 degrees;

a seventeenth angular displacement of approximately 19.1 degrees;

an eighteenth angular displacement of approximately 19.1 degrees;

a nineteenth angular displacement of approximately 16.9 degrees;

a twentieth angular displacement of approximately 14.7 degrees;

a twenty-first angular displacement of approximately 13.8 degrees; and a twenty-second angular displacement of approximately 14.3 degrees.

9. The blower assembly of claim 1 wherein the at least one tab has a unitary, one-piece construction with the circular blade support.

10. A blower assembly comprising:

a housing;

a cross flow fan mounted to the housing and rotatable about an axis, the cross flow fan having opposite ends spaced apart from each other along the axis;

first and second circular blade supports of the cross flow fan at the ends of the cross flow fan, the first and second circular blade supports blocking airflow in the axial direction into the cross flow fan, wherein the first circular blade support has a center portion;

a hub connecting the center portion of the first circular blade support to the housing;

at least one flow interrupter having a base portion connected to the first circular blade support, the at least one flow interrupter being disposed radially outward from the center portion of the first circular blade support;

a plurality of blades of the cross flow fan connected to the first circular blade support radially outward from the at least one flow interrupter and spaced circumferentially about the first circular blade support;

a free tip portion of the at least one flow interrupter spaced from the base portion, the free tip portion being radially closer to the blades of the cross flow fan than to the hub; and wherein the first circular blade support has at least one opening at the at least one flow interrupter and the at least one opening and the at least one flow interrupter are radially aligned.

11. The blower assembly of claim 10 wherein the first circular blade support has a generally planar face and the at least one flow interrupter extends transversely to the face of the first circular blade support.

12. The blower assembly of claim 10 wherein the first circular blade support has a flat outer surface adjacent the at least one flow interrupter and the at least one flow interrupter is upstanding from the flat outer surface.

13. The blower assembly of claim 10 wherein the at least one flow interrupter includes a plurality of flow interrupters in a circular arrangement about the center portion of the first circular blade support.

14. The blower assembly of claim 10 wherein the at least one opening is disposed radially outward from the center portion of the first circular blade support and radially inward from the plurality of blades.

15. The blower assembly of claim 10 wherein the at least one flow interrupter includes a plurality of flow interrupters and the at least one opening includes an opening at each of the plurality of flow interrupters.

16. The blower assembly of claim 15 wherein the plurality of flow interrupters are in a circular arrangement about the center portion of the first circular blade support and the plurality of openings are in a corresponding circular arrangement about the center portion of the first circular blade support.

17. The blower assembly of claim 10 wherein the at least one flow interrupter has a polygonal shape.

18. The blower assembly of claim 10 further comprising an electric motor for rotating the cross flow fan and the motor includes a high electrical resistance rotor.

19. The blower assembly of claim 10 wherein the at least one flow interrupter includes a plurality of flow interrupters having different shapes.

20. The blower assembly of claim 10 wherein the at least one flow interrupter has a unitary, one-piece construction with the first circular blade support.

21. A blower assembly comprising:

a housing;

a cross flow fan mounted in the housing for rotating about an axis;

a first blade support and a second blade support of the cross flow fan;

at least one protrusion having a bent base connected to the first blade support and an unattached free end opposite the bent base, the at least one protrusion connected to the first blade support extending axially toward the second blade support; and at least one protrusion having a bent base connected to the second blade support and an unattached free end opposite the bent base, the at least one protrusion connected to the second blade support extending axially toward the first blade support.

22. The blower assembly of claim 21 wherein the at least one protrusion connected to the first blade support includes a plurality protrusions in a spaced, generally circular arrangement about the first blade support.

23. The blower assembly of claim 22 wherein the at least one protrusion connected to the second blade support includes a plurality of protrusions in a spaced, generally circular arrangement about the second blade support.

24. The blower assembly of claim 21 wherein at least one of the first blade support and the second blade support includes at least one through opening at the at least one protrusion.

25. The blower assembly of claim 21 wherein at least one of the first blade support and the second blade support includes a plurality of protrusions and the at least one of the first blade support and the second blade support includes a corresponding plurality of through openings in the at least one of the first blade support and the second blade support.

26. The blower assembly of claim 21 wherein the cross flow fan includes a plurality of blades mounted to the first and second blade supports at unevenly spaced positions about the circumferences of the first and second blade supports.

27. The blower assembly of claim 26 wherein the plurality of blades are sinusoidally spaced about the circumferences of the first and second blade supports.

28. The blower assembly of claim 26 wherein at least one of the first blade support and the second blade support includes a plurality of protrusions at evenly spaced positions about the at least one of the first blade support and the second blade support.

29. The blower assembly of claim 21 further comprising an electrical motor for rotating the cross flow fan about the axis and the motor includes a high electrical resistance rotor.

30. The blower assembly of claim 21 wherein the cross flow fan includes a third blade support having at least one protrusion extending axially toward one of the first and second blade supports.

31. The blower assembly of claim 30 wherein the third blade support includes at least two protrusions with one protrusion extending axially toward the first blade support and another protrusion extending axially toward the second blade support.

32. The blower assembly of claim 21 wherein the at least one protrusion connected to the first blade support has a unitary, one-piece construction with the first blade support; and the at least one protrusion connected to the second blade support has a unitary, one-piece construction with the second blade support.

33. The blower assembly of claim 21 wherein the at least one protrusion includes at least one v-shaped ridge.

* * * * *